US009272838B2

(12) United States Patent
Tsuei

(10) Patent No.: US 9,272,838 B2
(45) Date of Patent: Mar. 1, 2016

(54) CONFORMABLE FACE MASK PACKAGING AND DISPENSING SYSTEMS

(71) Applicant: 3M INNOVATIVE PROPERTIES COMPANY, St. Paul, MN (US)

(72) Inventor: Alexander C. Tsuei, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 14/420,032

(22) PCT Filed: Aug. 8, 2013

(86) PCT No.: PCT/US2013/054196

§ 371 (c)(1),
(2) Date: Feb. 6, 2015

(87) PCT Pub. No.: WO2014/026037

PCT Pub. Date: Feb. 13, 2014

(65) Prior Publication Data

US 2015/0191299 A1 Jul. 9, 2015

Related U.S. Application Data

(60) Provisional application No. 61/681,794, filed on Aug. 10, 2012.

(51) Int. Cl.

| | |
|---|---|
| ***B65D 85/24*** | (2006.01) |
| ***B65D 85/16*** | (2006.01) |
| ***B65D 83/08*** | (2006.01) |
| ***B65B 35/50*** | (2006.01) |
| *B65D 85/18* | (2006.01) |

(52) U.S. Cl.

CPC ..... *B65D 85/16* (2013.01); *B65B 35/50* (2013.01); *B65D 83/0894* (2013.01); *B65D 85/18* (2013.01)

(58) Field of Classification Search

CPC combination set(s) only.
See application file for complete search history.

(56) References Cited

U.S. PATENT DOCUMENTS

| | | | |
|---|---|---|---|
| 2,619,226 | A | 11/1952 | Adams |
| 3,306,492 | A | 2/1967 | Kugler |
| 4,131,195 | A | 12/1978 | Worrell, Sr. |
| 4,215,862 | A | 8/1980 | Yoshikawa |

(Continued)

FOREIGN PATENT DOCUMENTS

| | | |
|---|---|---|
| WO | WO 2010-086645 | 8/2010 |
| WO | WO 2011-109458 | 9/2011 |

OTHER PUBLICATIONS

International Search Report for PCT International Application No. PCT/US2013/054196, mailed on Nov. 1, 2013, 3pgs.

*Primary Examiner* — Jacob K Ackun
(74) *Attorney, Agent, or Firm* — Lisa P. Fulton

(57) ABSTRACT

A system for containing a stack of face masks and dispensing individual face masks from the stack. The system includes a container and a stack of folded face masks. The container has a bottom panel forming a cut-line that defining a flap that is transitionable to an open state to generate an opening in the bottom panel. The stack is disposed within the container, and each face mask includes an elastic sheet forming a central portion and opposing first and second lateral end portions. Each face mask is folded such that a section of the first lateral end portion extends from a first fold line along the central portion. In a dispensing mode, the first lateral end portion of a bottommost folded face mask naturally drops through the opening due to gravity.

21 Claims, 14 Drawing Sheets

(56) References Cited

U.S. PATENT DOCUMENTS

| | | | | | |
|---|---|---|---|---|---|
| 4,269,315 | A | | 5/1981 | Boyce | |
| 4,375,718 | A | | 3/1983 | Wadsworth | |
| 4,453,629 | A | * | 6/1984 | Goldberg | B65D 75/322 206/445 |
| 4,550,856 | A | | 11/1985 | Ballmann | |
| 4,592,815 | A | | 6/1986 | Nakao | |
| 4,673,084 | A | * | 6/1987 | Hubbard et al. | B65D 5/541 206/278 |
| 4,848,575 | A | | 7/1989 | Nakamura | |
| 4,874,659 | A | | 10/1989 | Ando | |
| 5,401,446 | A | | 3/1995 | Tsai | |
| 6,763,970 | B2 | | 7/2004 | Harris | |
| 6,868,984 | B2 | | 3/2005 | Griesbach, III | |
| 8,359,817 | B2 | * | 1/2013 | Tai et al. | B65B 61/184 206/581 |
| 2004/0056043 | A1 | | 3/2004 | Griesbach, III | |
| 2004/0078860 | A1 | | 4/2004 | Bell | |
| 2004/0099677 | A1 | | 5/2004 | Harris | |
| 2005/0051567 | A1 | | 3/2005 | Bell | |
| 2007/0262086 | A1 | | 11/2007 | Cook | |
| 2011/0114690 | A1 | * | 5/2011 | Hollander | A41D 13/1169 225/93 |

* cited by examiner

CONFORMABLE FACE MASK PACKAGING AND DISPENSING SYSTEMS

BACKGROUND

Protective face masks are useful in a number of fields. In the health care field, a face mask may be useful for protecting both the patient and the health care provider from airborne pathogens or for preventing the transfer of pathogens that reside in bodily fluids or other liquids. Wearing protective face masks may also be useful in many industrial settings.

Many protective face masks are constructed to have a front panel that covers the nose and mouth of a user and a securing device (e.g., manual tie straps) that can attach this front panel securely to the head of the user. Often, the front panel and the tie straps are created separately in separate processes and then attached to one another (e.g., using adhesives, staples or other mechanical fasteners). The attachment point between the front panel and the tie strap of a face mask may be broken, for example, by pulling on the tie strap.

Face masks are sometimes provided or packaged in a dispenser. For example, a nested stack of face masks may be provided in a carton or container from which the tie strap may be grasped. The user may grasp the tie strap and pull down, thereby causing the face mask onto which it is attached to be removed from the carton. Subsequently, a new face mask to be dispensed will fall into the place of the previously dispensed face mask, and the tie straps of the next-to-be-dispensed face mask will protrude from the carton. These types of dispensing arrangements suffer from the disadvantage of commonly dispensing more than one face mask when a user pulls on the elastic band or tie straps. Also, such an arrangement may fail to have the next-to-be-dispensed face mask being positioned in the dispensing position upon the removal of a preceding face mask. In this instance, the user must reach into the carton in order to grasp the face mask to be removed. This could cause the face mask to be damaged upon being grasped and pulled by the user. And, as mentioned above, pulling on the tie strap is a common way to break the face mask.

The dispenser packaging format employed with so-called single piece face masks may also be problematic. With this type of face mask, the front panel is formed integrally with side panels that otherwise provide openings that are used to attached the face mask to the wearer. The front panel and the side panels may be die cut from a web of material and may be formed at the same time. Some of these masks are stretchable to achieve a better fit on the face of the wearer. Due to the relatively planar and foldable nature of the single piece face mask, some packaging and dispensing techniques entail forming a stack of face masks in which adjacent ones of the face masks within the stack are interfolded with one another, and packaging the stack in a carton. As an outermost face mask is pulled through an opening in the carton, the next-to-be-dispensed face mask is partially pulled through the opening due to the interfolded relationship and is readily available for subsequent dispensing. While highly viable, this approach may entail a more complex manufacturing methodology in order to form the stack of interfolded face masks. Further, with these and other packaging configurations, the next-to-be-dispensed face mask may not consistently protrude from the carton, leading to possible user confusion.

Because of the problems associated with dispensing face masks, improved design and dispensing of face masks may be desirable.

SUMMARY

Some aspects in accordance with principles of the present disclosure relate to a system for containing a stack of face masks and dispensing individual face masks from the stack. The system includes a container and a stack of a plurality of folded face masks. The container defines an interior volume, and includes a top panel and a bottom panel. The bottom panel forms a cut-line defining a perimeter of a flap that is at least partially removable from a remainder of the bottom panel. In this regard, the flap is transitionable from a closed state in which the flap is contiguous with the remainder of the bottom panel along the cut-line, to an open state in which the flap is at least partially removed from the remainder of the bottom panel to generate an opening in the bottom panel to the interior volume. The stack of folded face masks is disposed within the interior volume, and each of the face masks includes an elastic sheet forming a central portion and opposing first and second lateral end portions extending from opposite sides, respectively, of the central portion. Further, each of the face masks within the stack is folded such that at least a section of the first lateral end portion extends from a first fold line along a first face of the corresponding central portion. In some embodiments, the face masks are further folded such that at least a section of the second lateral end portion extends from a second fold line along a second face of the central portion opposite the first face. Regardless, the stack includes a bottommost folded face mask located proximate the bottom panel. The first lateral end portion of the bottommost folded face mask faces the bottom panel. In a dispensing mode of the system, the top panel is above the bottom panel and the flap is in the open state. Further, at least a region of the first lateral end portion of the bottommost folded face mask naturally drops through the opening due to gravity, while the central portion of the bottommost face mask is retained within the container. The remaining face masks of the stack are supported by the bottommost face mask relative to the opening, and thus are also retained within the container. The exposed region of the first lateral end portion of the bottommost face mask is readily available to a user for grasping thereof and removal of the bottommost face mask from the container. Once removed, a region of the first lateral end portion of the next-to-be-dispensed face mask drops through the opening due to gravity and is readily available for subsequent user grasping and dispensing.

In some embodiments, the dispensing mode includes the first and second fold lines of the bottommost face mask abutting the bottom panel of the container, with the bottommost face mask extending across an entirety of at least one of a width and a length of the container opening. In yet other embodiments, the cut-line is discontinuous such that in the open state, the flap remains connected to the remainder of the bottom panel along a connection line, with the flap self-retaining the open state in the dispensing mode due, at least in part, to gravity.

DETAILED DESCRIPTION

Figure 1:
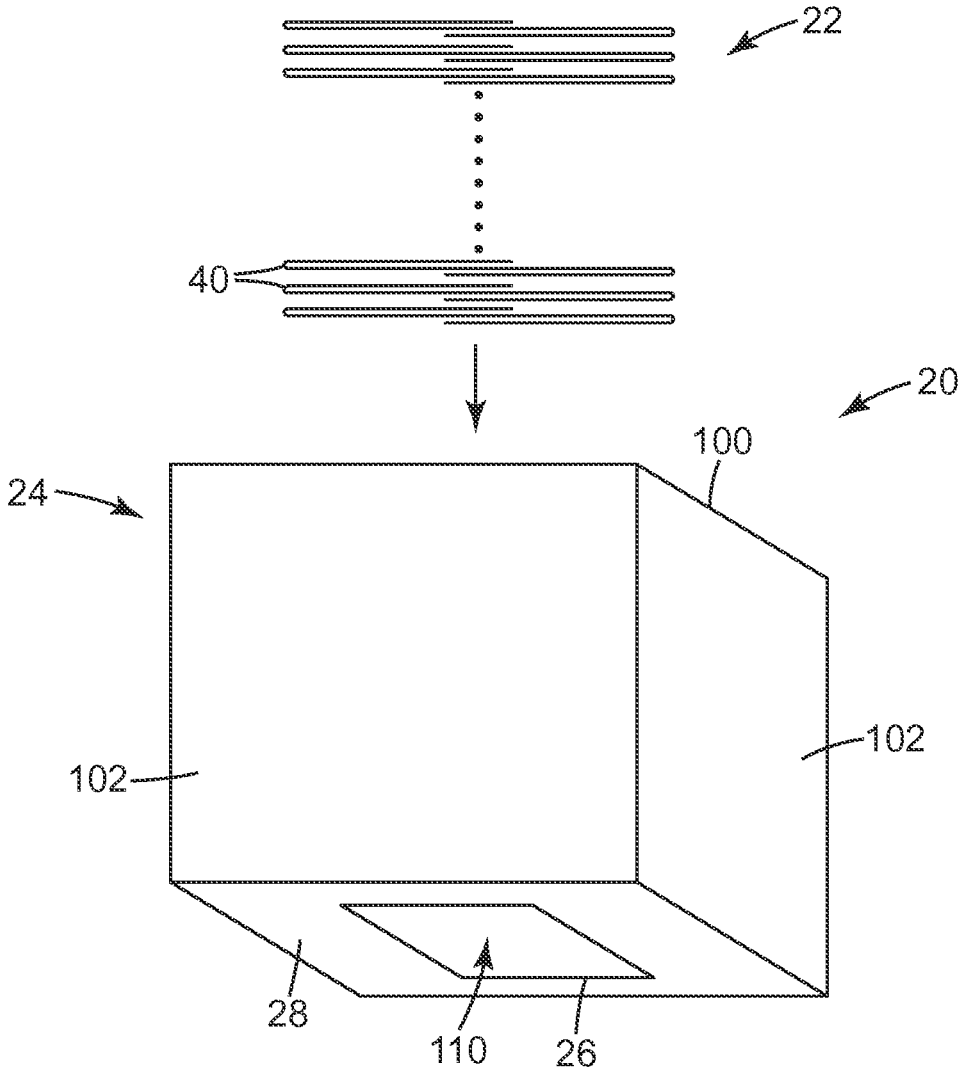
FIG. 1 is an exploded view, with portions shown in perspective, of a face mask packaging and dispensing system in accordance with principles of the present disclosure.

One embodiment of a face mask packaging and dispensing system 20 in accordance with the principles of the present disclosure shown in FIG. 1. The system 20 includes a face mask stack 22 and a container 24. Details on the various components are provided below. In general terms, the face mask stack 22 is disposed or packaged within the container 24. In a dispensing mode of the system 20, individual face masks of the stack 22 can be dispensed from an opening 26 in a bottom panel 28 of the container 24. In this regard, the system 20 is configured such that when the container 24 is arranged with the bottom panel 28 is below other panels of the container 24, and a region of a to-be-dispensed face mask naturally drops through the opening 26, is readily visually perceived by a user, and is available for grasping by the user when dispensing of the individual face mask is desired.

Figure 2:
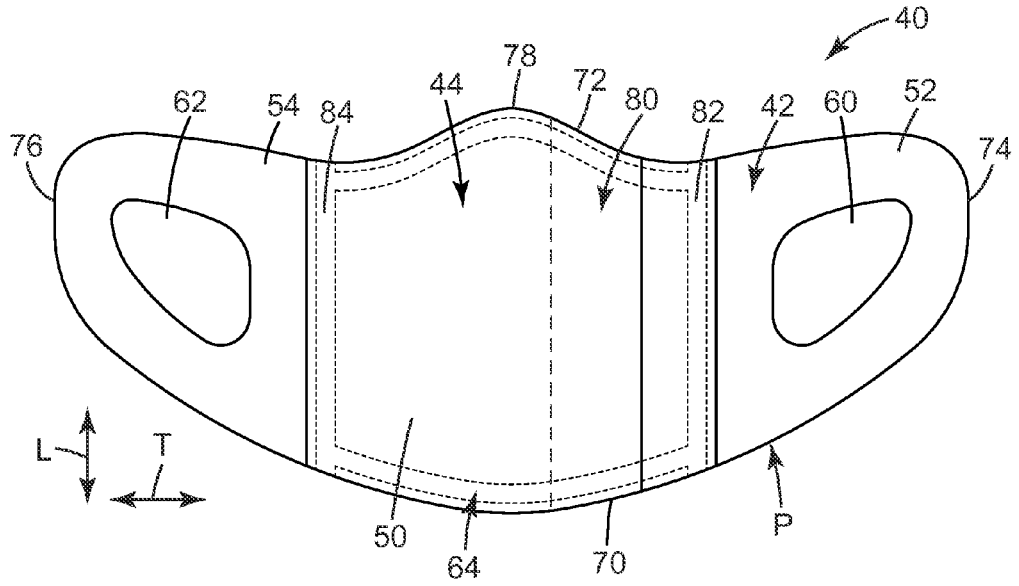
FIG. 2 is a plan view of a face mask useful with a face mask stack portion of the system of FIG. 1, which plan view is of the outward-facing side.

One embodiment of a face mask 40 is useful with the face mask stack 22 (FIG. 1) is shown in FIG. 2. The face mask 40 includes an elastic sheet 42 and an optional filtering web 44. In general terms, the elastic sheet 42 is configured for fastening to a user in a manner encompassing a mouth and at least a portion of the nose of the wearer. The filtering web 44 is bonded to the elastic sheet 42. Once the face mask 40 is fastened to the user, the filtering web 44 filters airflow to and from the user.

The elastic sheet 42 has an elongated shape generally defining a central portion 50 and first and second lateral end portions 52, 54 flanking the central portion 50 on opposite sides, respectively. In some embodiments, the central portion 50 may have a length in a transverse direction T of up to about 50 or 60 percent, and typically at least about 30 or 35 percent, of an overall length of the face mask 40 in the transverse direction T. The central portion 50 is configured for wearing over a mouth and at least a portion of a nose of a person, and the first and lateral end portions 52, 54 are each configured to at least partially extend along opposite sides of a person's face in a manner facilitating engagement with an ear of a person. In the illustrated embodiment, the first lateral end portion 52 can be configured to extend around the left side of a person's face, and the second lateral end portion 54 can be configured to extend around the right side of a person's face. In some embodiments, the first lateral end portion 52 forms an aperture 60 that can be used to engage a person's ear, and the second lateral end portion 54 has an aperture 62 to engage the person's other ear. In other embodiments, punch-out members can be used instead of the apertures 60, 62, and the punch-out portion of the punch-out member can be removed to form the corresponding aperture.

As a point of reference, in some embodiments, the central portion 50 and the first and second lateral end portion 52, 54 are formed from the same material as a unitary structure. In other words, the central portion 50 and the first and second lateral end portions 52, 54 are not formed as three separate pieces that are subsequently joined together. Rather, the central portion 50 and the first and second lateral end portions 52, 54 form a continuous, homogenous structure. Thus, while the central portion 50 may not be clearly demarcated in the elastic sheet 42 as a standalone structure, bonding of the filtering web 44 can be viewed as effectively defining a region of the central portion 50. For example, FIG. 2 reflects the filtering web 44 being bonded to the elastic sheet 42 at a bondline 64, with the bondline 64 effectively establishing a perimeter of the central portion 50. Also, face masks according to and/or made according to the present disclosure typically have a flat (i.e., planar) shape when they are not being worn. The term "flat" means any of the multiple portions are substantially parallel (i.e., within 10, 7.5, or 5 degrees of parallel) to a plane defined by the elastic sheet 42. The term "flat" also means that face masks disclosed herein do not have means (e.g., seals, seams or bonding) to urge the face mask as a whole into a bent or permanently curved folded position.

A perimeter P of the elastic sheet 42, and thus of the face mask 40, can be viewed as generally defining a lower edge 70, an upper edge 72, and opposing first and second side edges 74, 76. The elongated shape of the elastic sheet 42 defines the transverse direction T mentioned above and a longitudinal direction L. The transverse direction T is commensurate with the common direction of extension of the lateral end portions 52, 54 from the central portion 50, and the longitudinal direction L is perpendicular to the transverse direction T. In some embodiments, the longitudinal direction L corresponds with a machine direction of the elastic sheet 42 during manufacture of the face mask 40. With these designations in mind, the lower edge 70 of the perimeter P is collectively defined by the central portion 50 and the lateral end portions 52, 54, and can be characterized as continuously extending toward the upper edge 72 in extension from a center line of the elastic sheet 42 toward the corresponding side edge 74, 76. In some embodiments, the upper edge 72 is also collectively defined by or along the central portion 50 and lateral end portions 52, 54. While the upper edge 72 can exhibit a curvature toward the lower edge 70 in extension from the center line toward the corresponding side edge 74, 76 along the central portion 50 (e.g., a protrusion 78 is optionally formed in the upper edge 72), at least a segment of the upper edge 72 along the corresponding lateral end portion 52, 54 extends away from the lower edge 70 in extension toward the corresponding side edge 74, 76. With this shape, then, a user will readily understand that fastening of the face mask 40 to the wearer's face entails orienting the lower edge 70 in a vicinity of the wear's chin, and the upper edge 72 in a vicinity of the wearer's nose root. Alternatively, the perimeter P can assume a variety of shapes that may or may not convey a specific worn orientation to a user.

The elastic sheet 42 is made from a soft, flexible material or materials that allow face masks according to the present disclosure to be readily dispensed from a container. The elastic sheet 42 is a resilient material so that the corresponding lateral end portion 52, 54 can be pulled from a dispenser without deforming or tearing the elastic sheet 42. Further, the resilient, flexible attribute of the elastic sheet 42 permits the face mask 40 to be folded in manner that does not permanently crease or crinkle as described below.

The elastic sheet 42 optionally includes minor holes (not shown) that can be provided over some or an entirety of the elastic sheet 42, including the central portion 50 and/or the lateral end portions 52, 54. While the elastic sheet 42 can be formed of an elastic nonwoven material that typically has some degree of porosity, the optional minor holes can be intentionally imparted to the elastic sheet 42 and can have a diameter in the range from about 0.5 mm to about 1.5 mm. The minor holes may be useful, for example, for increasing at least one of breathability, elongation, or comfort of the face mask 40. For example, if the face mask 40 is worn in a hot and/or humid environment, the minor holes provided in the elastic sheet 42 may allow for the passage of air to improve comfort. The minor holes in the first and second lateral end portions 52, 54 and otherwise spaced away from the central portion 50 can balance the desire for breathability, elongation, or comfort, as well as the desire for a good seal of the face mask 40 around the wearer's nose and mouth. In other embodiments, the minor holes can be omitted.

The elastic sheet 42 can have a color other than white or could have a pattern of multiple colors. In other embodiments, the elastic sheet 42 can be imparted with a graphic. The term "graphic" means any design, shape, pattern or picture that is visible on the face mask 40, and specifically includes text (e.g., including one or more alphanumeric symbol), pictorial images that include one or more pictures, and combinations thereof. Color patterns and/or graphics may provide enjoyment for the wearer, for example, when the wearer is a child.

The elastic sheet 42 is configured to stretch in one or more directions. In some embodiments, the elastic sheet 42 has elongation of at least 5 (in some embodiments, at least 10, 25, 40, 50, 75, or 100) percent and up to about 150, 200, 250, 300, 350, or 500 percent in at least one direction. The elongation in terms of percent stretch is [(the extended length–the initial length)/the initial length] multiplied by 100. For example, if a material having an initial length of 1 cm can be stretched 0.50 cm, that is to an extended length of 1.50 cm, the material can be said to have an elongation of 50 percent. In some embodiments, the elastic sheet 42 can stretch in both the transverse direction T and the longitudinal direction L. In some embodiments, all of the central portion 50 and lateral end portions 52, 54 can be stretched in one or more directions. The ability of the elastic sheet 42 to stretch in at least one of the transverse T or longitudinal L directions will typically allow for fuller coverage of the wearer's face and provide for more flexibility in accommodating variously sized faces of potential users. In particular, horizontal and vertical stretching in the central portion 50 will typically allow for better fitting on the face.

The elastic sheet 42 also exhibits recovery from stretching. Recovery refers to a contraction of a stretched material upon termination of biasing force following stretching of the material by application of the biasing force. For example, if a material having a relaxed, unbiased length of 1.0 cm is elongated 50 percent by stretching to a length of 1.5 cm and subsequently contracts to a length of 1.1 cm after release of the stretching force, the material would have recovered 80 percent (0.4 cm) of its elongation. The elastic sheet 42 can have a recovery of, for example, at least 25, 50, 60, 70, 75, or 80 percent.

In some embodiments, different segments of the central portion 50 may have different elongations in the same direction. For example, at the lower and upper edges 70, 72 along the central portion 50, the elongation may be up to 5 (in some embodiments 4, 3, 2, or 1) percent in the transverse direction T, while between the lower and upper edges 70, 72, the elongation may be greater than 5 and up to 15 (in some embodiments 14, 13, 12, 11, or 10) percent in the transverse direction T. In other embodiments, at the lower and upper edges 70, 72 along the central portion 50, the elongation may be up to 5 (in some embodiments 4, 3, 2, or 1) percent in the transverse direction T, while between the lower and upper edges 70, 72, the elongation may be at least 70 (in some embodiments, at least 75, 80, or 85) percent in the transverse direction T. Reduced elongation at the lower and upper edges 70, 72 may be useful, for example, for providing a good seal against the user's face. In some embodiments, the central portion 50 has elongation of less than 10 (in some embodiments, up to 7.5, 5, 2.5, or 2, or 1) percent in the transverse direction T. In some embodiments, the first lateral end portion 52 and the second lateral end portion 54 each have an elongation of at least 15 (in some embodiments, at least 20, 25, 30, 40, 50, 75, or 90 or 100) percent and up to about 500 (in some embodiments, up to 350, 300, 250, or 200) percent in at least one of the longitudinal direction L or transverse direction T. The amount of elongation in the central portion 50 can be controlled, for example, by the choice of materials, the extent of attachment of the filtering web 44 to the central portion 50, and other features provided by filtering web 44. Limiting the elongation of the central portion 50 may allow for better filtration properties.

Various materials can be employed for the elastic sheet 42. For example, in some constructions, the elastic sheet 42 is an elastic nonwoven web. In some embodiments, the elastic nonwoven web or portion thereof comprises a spunbonded, meltblown, or spunlace nonwoven. The term "spunbonded" refers to small diameter fibers that are formed by extruding a molten thermoplastic material as filaments from a plurality of fine, usually circular, capillaries of a spinneret with the diameter of the extruded filaments then being rapidly reduced to fibers. Spunbond fibers are generally continuous and have diameters generally greater than about 7 microns, more particularly, between about 10 and about 20 microns. The term "meltblown" refers to fibers formed by extruding a molten thermoplastic material through a plurality of fine, usually circular, die capillaries as molten threads or filaments into converging high velocity, usually hot, gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Meltblown fibers are generally microfibers which may be continuous or discontinuous with diameters generally less than 10 microns. Spunlacing uses high-speed jets of water to strike a web to intermingle the fibers of the web. Spunlacing is also known as hydroentangling and can be carried out on fibrous webs made, for example, using carded webs and air laid webs.

Exemplary useful materials for making the elastic nonwoven web or portion thereof (e.g., the elastic sheet 42) include thermoplastic elastomers such as ABA block copolymers, polyurethane elastomers, polyolefin elastomers (e.g., metallocene polyolefin elastomers), polyamide elastomers, ethylene vinyl acetate elastomers, and polyester elastomers. An ABA block copolymer elastomer generally is one where the A blocks are polystyrenic, and the B blocks are conjugated dienes (e.g., lower alkylene dienes). The A block is generally formed predominantly of substituted (e.g., alkylated) or unsubstituted styrenic moieties (e.g., polystyrene, poly(alphamethylstyrene), or poly(t-butylstyrene)), having an average molecular weight from about 4,000 to 50,000 grams per mole. The B block(s) is generally formed predominantly of conjugated dienes (e.g., isoprene, 1,3-butadiene, or ethylene-butylene monomers), which may be substituted or unsubstituted, and has an average molecular weight from about 5,000 to 500,000 grams per mole. The A and B blocks may be configured, for example, in linear, radial, or star configurations. An ABA block copolymer may contain multiple A and/or B blocks, which blocks may be made from the same or different monomers. A typical block copolymer is a linear ABA block copolymer, where the A blocks may be the same or different, or a block copolymer having more than three blocks, predominantly terminating with A blocks. Multiblock copolymers may contain, for example, a certain proportion of AB diblock copolymer, which tends to form a more tacky elastomeric film segment. In some embodiments, the elastic nonwoven sheet useful for practicing the present disclosure is made from a variety of useful materials (e.g., polypropylene, polypropylene-polyethylene copolymers, and thermoplastic polyurethanes). In some embodiments, the elastic nonwoven web is made, for example, from multicomponent (e.g., bi-component such as core-sheath) fibers. In some embodiments, the elastic nonwoven web is a multilayer laminate of different materials (e.g., the materials described above) in the layers. For example, the elastic nonwoven web may comprise a layer of meltblown fibers between two layers of spunbonded fibers.

Materials can be selected for the elastic nonwoven portion or sheet, for example, depending on how they feel against the skin. The elastic nonwoven sheet can be made from materials that feel soft against the skin. The elastic nonwoven sheet can also be made from materials that have a rubbery feeling so that they can stay in place.

Several materials useful for making the elastic nonwoven sheet are commercially available, for example, polyolefins from ExxonMobil, Houston, Tex., under the trade designation "VISTAMAXX" and thermoplastic polyurethane elastomers from Huntsman, The Woodlands, Tex., under the trade designation "IROGRAN". In some embodiments, the elastic nonwoven sheet comprises a matrix nonwoven material. In some embodiments, the elastic nonwoven sheet comprises a spunbond nonwoven available from Idemitsu Kosan Co., Ltd., Tokyo, Japan, under the trade designation "STRAFLEX". In other embodiments, the elastic sheet 42 is a bicomponent elastic nonwoven web employing a styrenic block copolymer core material and a sheath material. For example, a bicomponent elastic nonwoven web of styrenic block copolymer core available from Kraton Polymers LLC, Houston, Tex. (under the trade designation G1643, MD6705, or MD6717) and a polypropylene sheath. The core:sheath radio can be 85:15 or 80:20, for example.

The filtering web 44 is bonded to the central portion 50 as described in greater detail below. The term "filtering" with respect to the filtering web 44 described herein refers to separating or removing a portion of the exhalation from the face mask wearer or a portion of the inhalation, encountered by the face mask wearer. The filtering web 44 is typically capable of at least one of providing a barrier to the transmission of pathogenic microorganisms to or from the wearer, trapping allergens (e.g., pollen), trapping particulates, trapping or masking odors, trapping or providing a barrier to liquids, removing cold air (i.e., providing thermal insulation), or reducing viral or bacterial contamination.

Figure 3:
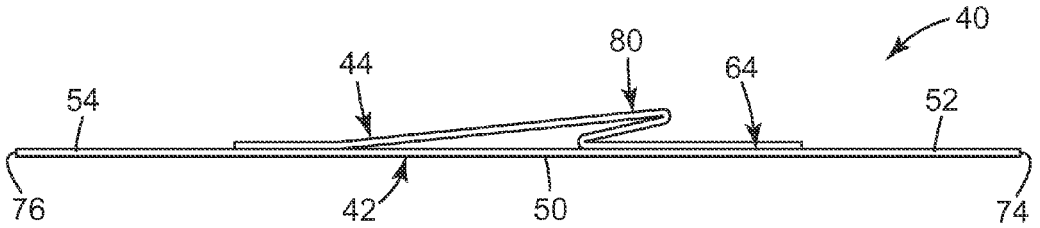
FIG. 3 is a cross-sectional view of the face mask of FIG. 2.

As shown in FIGS. 2 and 3, the filtering web 44 optionally forms at least one pleat 80. In some embodiments, the pleat 80 is a flat pleat made, for example, by folding the filtering web 44 material back on itself a first time, and then folding it back on itself a second time as illustrated in FIG. 3. Although the pleat 80 is shown in FIG. 3 as a single pleat, double pleats or other multiple pleats may also be used with face masks of the present disclosure. For double pleats, the above-described folding pattern is usually repeated twice with the same folding direction. For multiple pleats, this folding pattern is usually repeated multiple times. In flat-pleated material, a majority of the pleated material is substantially parallel (i.e., within 10, 7.5, or 5 degrees of parallel) to a plane defined by the elastic sheet 42. Flat pleats as shown in FIG. 3 are useful for allowing compact stacking of the face masks disclosed herein. The pleat 80 is shown in FIG. 2 as being arranged to extend substantially parallel (i.e., within 10 degrees of parallel) of the longitudinal direction L, and thus can be referred to as a vertical pleat (i.e., when the face mask 40 is worn by a user and the user is upright, the pleat 80 has a vertical orientation). While a single vertical pleat 80 is illustrated, in other embodiments, two or more vertical pleats can be provided. Alternatively, or in addition, the filtering web 44 can form or include one or more horizontal pleats.

A variety of materials are useful for making the filtering web 44. In some embodiments, the filtering web 44 is a nonwoven material (e.g., a polyproylene nonwoven material). Alternatively, the filtering web 44 can be a microreplicated perforated film. The filtering web 44 may also include multiple layers of nonwoven materials or microreplicated perforated films. In some embodiments, the filtering web 44 is electrically charged. Charged filtration medium typically increases filtration efficiency by drawing particles to be filtered toward the filter by virtue of their electrical charge. In some embodiments, the filtering web 44 is an electret. Electret treatment can be carried out by a number of techniques (e.g., those described in U.S. Pat. Nos. 5,401,446; 4,215,862; 4,375,718; 4,592,815; and 4,874,659, the disclosures of which are incorporated herein by reference in their entirely). In some embodiments, the filtering web 44 has a filtering efficiency of at least 99 (in some embodiments, 98, 97, 96, or 95) percent.

In some embodiments, the filtering web 44 can be configured (or additional materials can be associated with the filtering web 44) to provide one or more additional performance attributes such as, for example, protecting the wearer from unpleasant odors; thermal insulation; viral, bacterial, fungal protection; and/or a liquid barrier.

With embodiments in which the face mask 40 includes the filtering web 44, one or more optional cut-outs (not shown) can be formed in the elastic sheet 42. The term "cut-out" is intended to include cuts in the elastic sheet 42 that do not remove material (i.e., slits) and cuts in the elastic sheet 42 that remove material (i.e., holes). In some constructions, the cut-out is configured to facilitate insertion of the user's mouth and portion of the nose there through, with the filtering web 44 thus establishing a chamber about the user's mouth and portion of the nose (i.e., the face mask 40 is intended to be worn with the elastic sheet 42 facing the user, and the filtering web 44 opposite the user's face). In other embodiments, the cut-outs can allow the pleat 80 to extend there through when the mask is worn (i.e., the face mask 40 is intended to be worn with the filtering web 44 facing the user). In yet other embodiments, the cut-out is omitted.

Where provided, the filtering web 44 is bonded, either directly or indirectly, to a surface of the elastic sheet along the perimeter bondline 64. The perimeter bondline 64 can be continuous as shown, and can follow a shape and contour of the filtering web 44 but in other configurations can be offset from the filtering web 44 edge at various locations. Regardless, the perimeter bondline 64 can define a first segment 82 extending in the longitudinal direction L between the central portion 50 and the first lateral end portion 52, and a second segment 84 extending in the longitudinal direction L between the central portion 50 and the second lateral end portion 54.

In some constructions, the perimeter bondline 64 is an ultrasonically-formed bond. Alternatively, other bonding formats are also acceptable such as adhesive, hot melt, thermal needle punch, etc. The filtering web 44 can be bonded directly on to the elastic sheet 42, or one or more additional layers or materials can be disposed between the filtering web 44 and the elastic sheet 42 (such that the filtering web 44 is indirectly bonded to the elastic sheet 42).

Figure 4A:
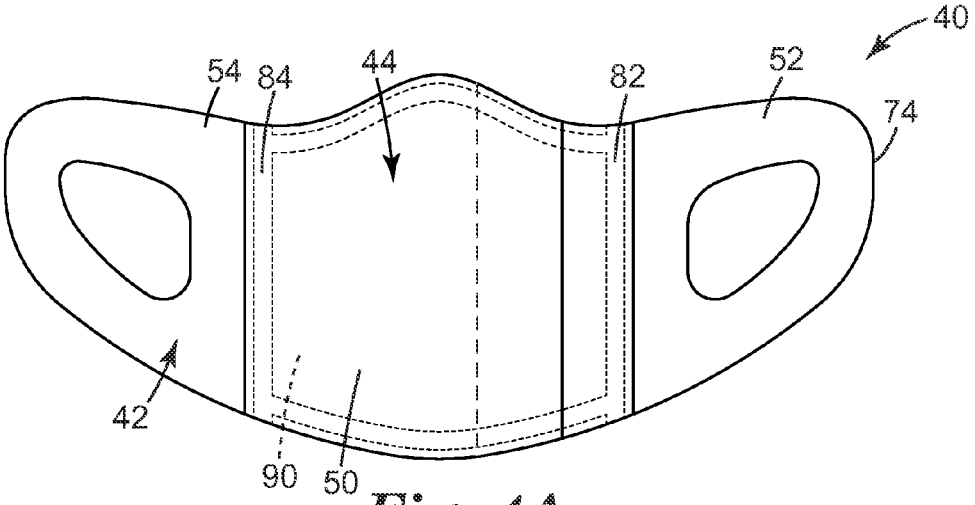
FIGS. 4A-4C illustrate one embodiment of folding the face mask of FIG. 2 to generate a folded face mask useful with the system of FIG. 1.
Figure 4B:
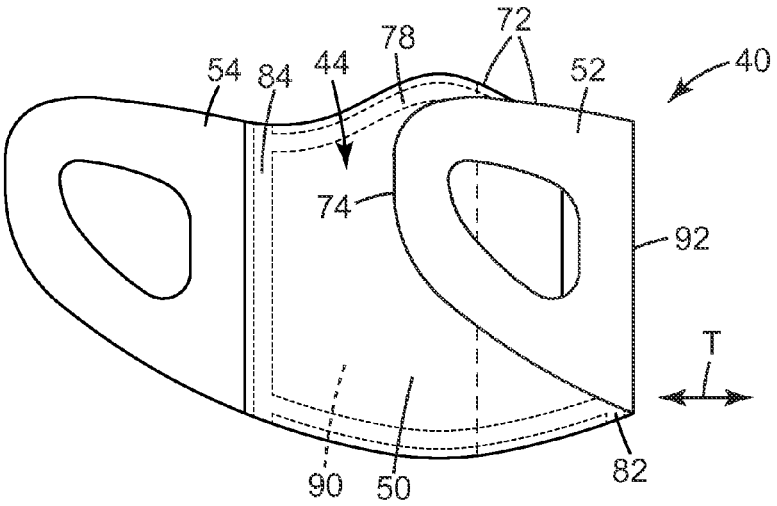
Figure 4C:
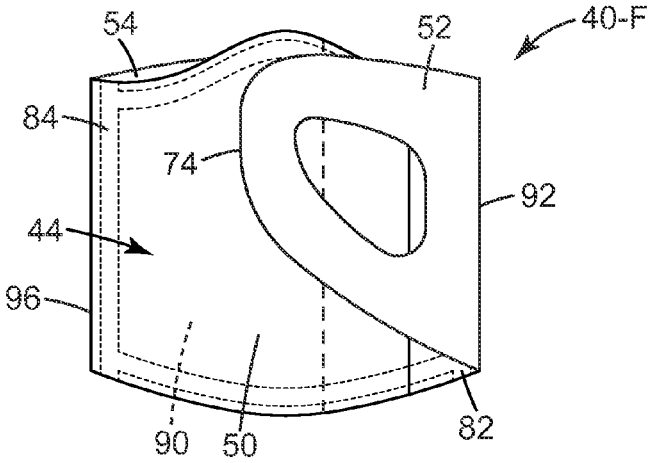

Returning to FIG. 1, each of the face masks 40 within the stack 22 are individually folded. FIGS. 4A-4C illustrate one folding technique envisioned by the present disclosure. Starting from the flat, unfolded state of FIG. 4A, the first lateral end portion 52 is folded onto a first face 90 of the central portion 50 as shown in FIG. 4B (it being understood that in the view of FIGS. 4A-4C, the central portion first face 90 is "covered" by the optional filtering web 44). The first bondline segment 82 (otherwise demarcating the central portion 50 and the first lateral end portion 52) serves as a natural location for the fold. Regardless, a first fold line 92 is defined, with at least a section of the first lateral end portion 52 extending along the first face 90 of the central portion 50. For example, at least 50, 60, 70, or 80 percent of a surface area of the first lateral end portion 52 extends along and "covers" the central portion 50 at the first face 90 (i.e., directly contacts the central portion 50 of the elastic sheet 42 or the filtering web 44 attached to the elastic sheet 42). In some embodiments, a transverse length of the first lateral end portion 52 (e.g., distance in the transverse direction T between the first bondline segment 82 and the first side edge 74) is less than a transverse length of the central portion 50. With this (and other) configuration, following folding of the first lateral end portion 52 at the first fold line 92, the first side edge 74 terminates at a location "within" an area of the central portion 50. Stated otherwise, in the folded state, the first side edge 74 is between the first and second bondline segments 82, 84. In some embodiments, a shape of the upper edge 72 is such that in the folded state of FIG. 4B, the upper edge 72 along the first lateral end portion 52 is offset or "below" a portion of the upper edge 72 (e.g., the protrusion 78) along the central portion 50 as shown.

Figure 5:
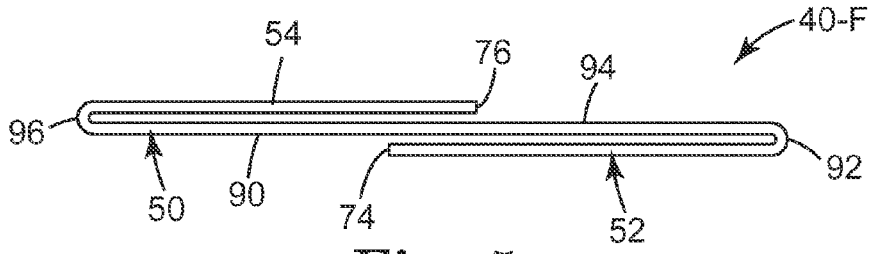
FIG. 5 is a simplified side view of the folded face mask of FIG. 4C.

The second lateral end portion 54 is similarly folded relative to the central portion 50 as shown in FIG. 4C, except that at least a section of the second lateral end portion 54 is arranged to extend over an opposing, second face 94 of the central portion 50. As a point of reference, the folded second lateral end portion 54 is primarily hidden in the view of FIG. 4C; in the side view of FIG. 5, however, the folded second lateral end portion 54, as well as the second face 94 of the central portion 50, is illustrated. A second fold line 96 is established, and can be naturally formed at the second bondline segment 84. In the final, folded state of FIG. 5 (the optional filtering web 44 (FIG. 4A) is omitted from the view of FIG. 5 for ease of illustration), the second side edge 76 of the second lateral end portion 54 is arranged within an area of the central portion 50, as is the first side edge 74 of the first lateral end portion 52. Due to the resilient, flexible construction of the elastic sheet 42 (as well as other materials of the face mask 40), the fold lines 92, 96 are not permanent creases. Instead, the lateral end portions 52, 54 are readily unfolded from the folded state of FIG. 5. For ease of explanation, the final folded state of FIGS. 4C and 5 is referred to as a folded face mask 40-F.

Figure 6A:
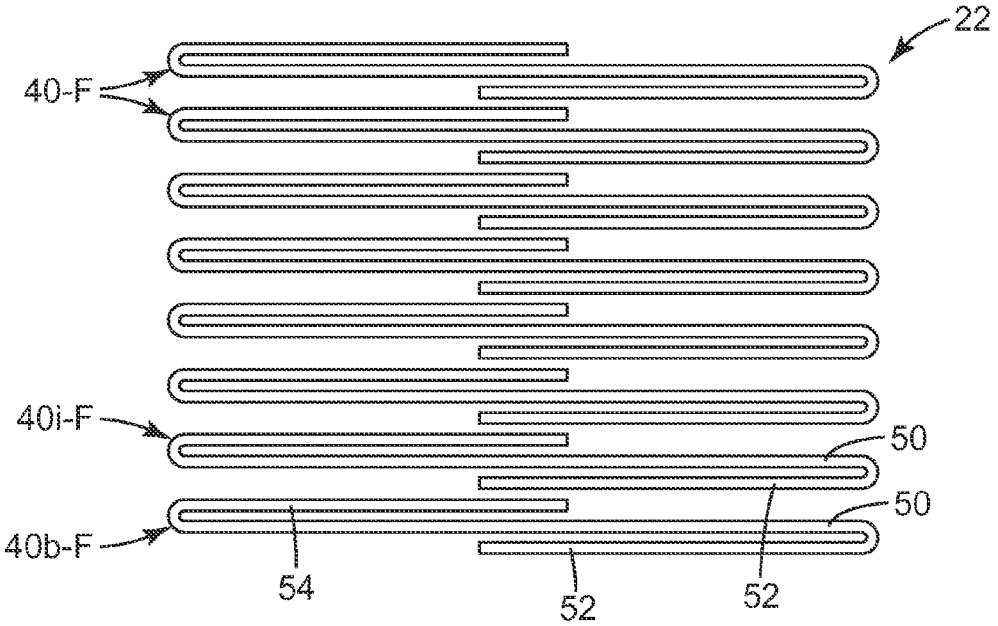
FIG. 6A is a simplified side view of the face mask stack of FIG. 1.
Figure 6B:
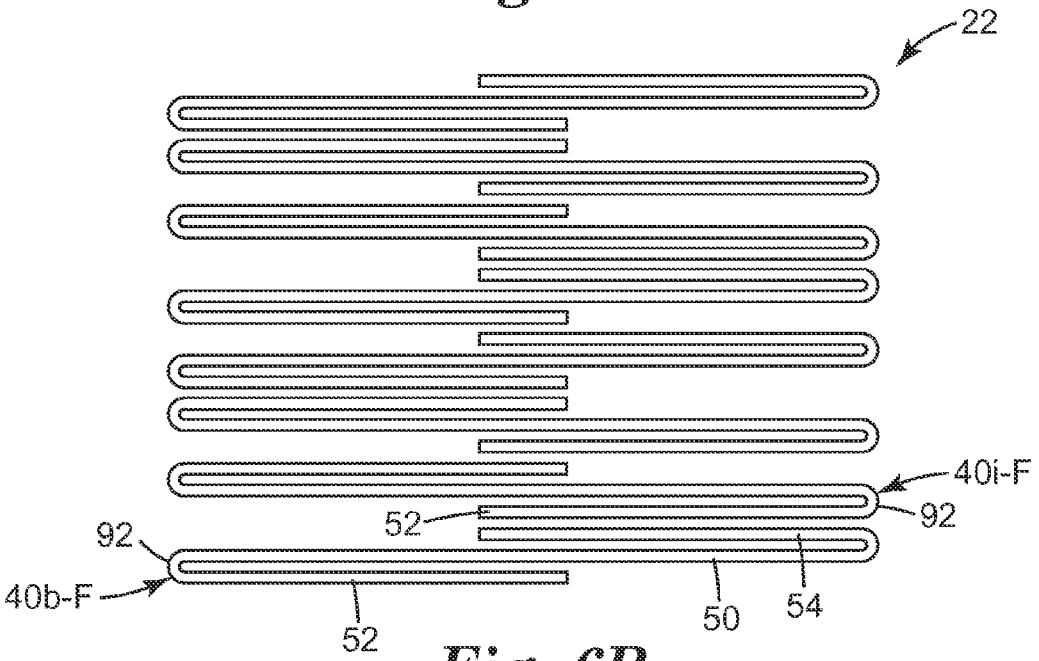
FIG. 6B is a simplified side view of another face mask stack useful with the system of FIG. 1.

One embodiment of the face mask stack 22 is shown in greater detail in FIG. 6A. The folded face masks 40-F comprising the stack 22 are folded identically (as described above) and stacked onto one another. In some embodiments, the individual folded face masks 40-F are not interfolded with one another. For example, relative to a bottommost folded face mask 40*b*-F and an immediately next folded face mask 40*i*-F, the second lateral end portion 54 of the bottommost folded face mask 40*b*-F is not disposed between the first lateral end portion 52 and the central portion 50 of the immediately next folded face mask 40*i*-F. Further, FIG. 6A illustrates that in some embodiments, each of the folded face masks 40-F within the stack 22 are arranged in an identical fashion (i.e., relative to the orientation of FIG. 6A, the folded first lateral end portion 52 of each of the folded face masks 40-F is "below" the corresponding second lateral end portion 54 and is located on the right hand side). Alternatively, the folded face masks 40-F within the stack 22 can have differing relationships relative to one another as shown, for example, in FIG. 6B. More particularly, and relative to the orientation of FIG. 6B, the bottommost folded face mask 40*b*-F is arranged such that the folded first lateral end portion 52 is below the corresponding central portion 50, and the first fold line 92 is at the left hand side of the stack 22. The immediately next folded face mask 40*i*-F is arranged such that the first lateral end portion 52 is above the second lateral end portion 54 of the bottommost folded face mask 40*b*-F, and the first fold line 92 of the immediately next folded face mask 40*i*-F is at the right hand side of the stack 22. Remaining ones of the folded face masks 40-F within the stack 22 can be arranged at either orientation, either randomly or in a patterned fashion. Returning to FIG. 1, the container 24 is generally sized and shaped for containing the stack 22, as well as to facilitate dispensing of individual ones of the face masks 40 when desired by a user. The container 24 can assume a variety of forms, and generally includes the bottom panel 28, a top panel 100 (referenced generally), and a plurality of side panels 102 between the bottom and top panels 28, 100. In some constructions, the panels 28, 100, 102 are formed of paperboard, cardboard or similar material, and are folded relative to one another in completing the container 24. Alternatively, a wide variety of other materials are equally acceptable. For example, one or more of the panels 28, 100, 102 can be formed of a plastic material. Further, while the panels 28, 100, 102 are each illustrated as being complete or homogenous bodies, in other embodiments, one or more of the panels 28, 100, 102 can consist of two or more bodies that are connected to one another in defining the corresponding, completed panel 28, 100, 102 (e.g., where the container 24 is formed from a paperboard material, the container 24 can be assembled from a paperboard flat in which various flaps are folded and coupled or adhered to one another). In yet other embodiments, one or more of the panels 28, 100, 102 need not be permanently connected to one another (e.g., the bottom panel 28 and the side panels 102 can be formed from a first body, with the top panel 100 being separately formed and subsequently assembled to the side panels 102). Regardless of the container construction, the container 24 defines an interior volume 110 sized and shaped to receive and contain the face mask stack 22 as described below.

Figure 7A:
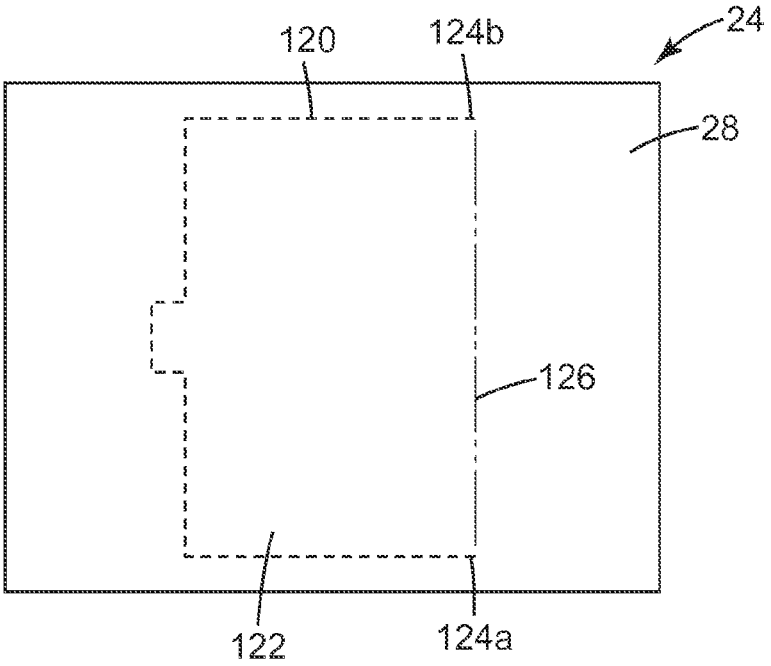
FIG. 7A is a bottom plan view of a container portion of the system of FIG. 1, and illustrating a bottom panel of the container in a closed state.

As a point of reference, the terms "bottom panel" and "top panel" are in reference to an intended orientation of the container 24 during use of the system 20. That is to say, in the intended spatial orientation, the bottom panel 28 will be "below" the top panel 100, and individual face masks are dispensed through the bottom panel 28. With this in mind, the bottom panel 28 forms a cut-line 120 as shown in FIG. 7A. The cut-line 120 is, in some embodiments, a line of perforations through a thickness of the bottom panel 28, and defines a perimeter of a flap 122. The cut-line 120 can be discontinuous, terminating at opposing ends 124*a*, 124*b*. As a result of this construction, while the flap 122 can be partially removed or withdrawn from a remainder of the bottom panel 28, the flap 22 remains connected to a remainder of the bottom panel 28 along a theoretical connection line 126 (referenced generally) between the cut-line ends 124*a*, 124*b*. In other embodiments, the cut-line 120 can be continuous, with the resultant flap 122 capable of being entirely removed from a remainder of the bottom panel 28.

Figure 7B:
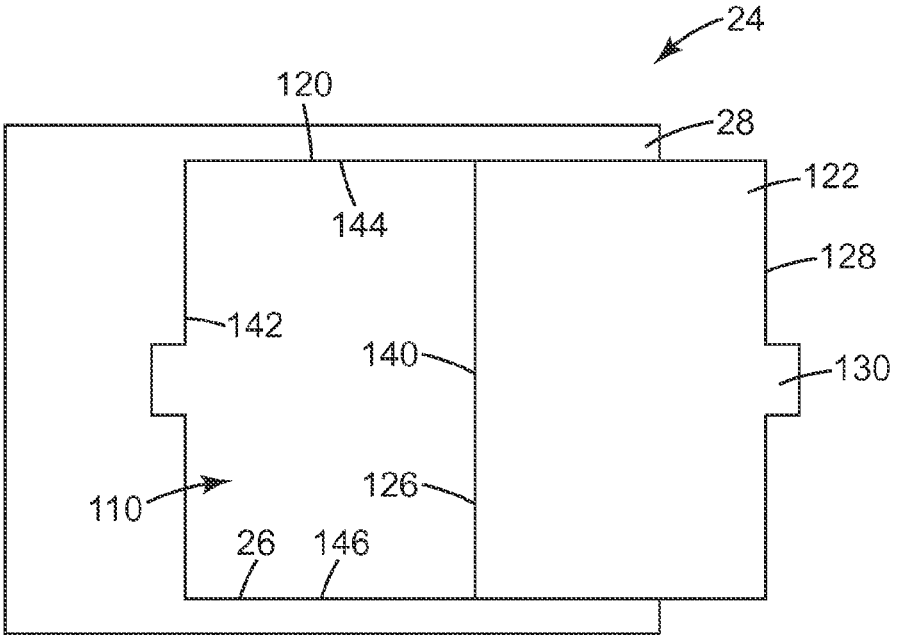
FIG. 7B is a bottom plan view of the container of FIG. 1 and illustrating the bottom panel of FIG. 7A in an open state.

The above-described configuration of the cut-line 120/flap 122 serves to establish a closed state and an open state of the container 24. In the closed state of FIG. 7A, the flap 122 is contiguous with a remainder of the bottom panel 28 along the cut-line 120. In the open state of FIG. 7B, a portion of the flap 122 is removed (e.g., pivoted or pulled) away from a remainder of the bottom panel 28. For example, the flap 122 can be defined as having a leading end 128 opposite the hypothetical connection line 126. Transitioning of the container 24 from the closed state to the open state entails pulling the leading end 128 away from a remainder of the bottom panel 28, with the flap 122 effectively "pivoting" relative to a remainder of the bottom panel 28 along the connection line 126. A tab 130 is optionally defined along the leading end 128 that assists a user in transitioning the flap 122 from the closed state to the open state (e.g., prior to removal, the flap 122 is intermittently connected to a remainder of the bottom panel 28 along the perforations of the cut-line 120; the tab 130 can be pressed to break the intermittent connection, then grasped and pulled to further tear the flap 122 away from the remainder of the bottom panel 28). Regardless, in the open state, the opening 26 through the bottom panel 28 and to the interior volume 110 of the container 24 is established.

Regardless of whether the flap 122 remains connected to a remainder of the bottom panel 28 at the connection line 126, the opening 26 has a perimeter effectively defined by the cut-line 120 and the connection line 126, and can be viewed as having opposing first and second end edges 140, 142, and opposing first and second side edges 144, 146. As a point of reference, the first end edge 140 corresponds with the connection line 126, whereas the second end edge 142 corresponds with the leading end 128 of the flap 122. The edges 140-146 can assume various shapes, and can be linear, curved or curvilinear.

Figure 8A:
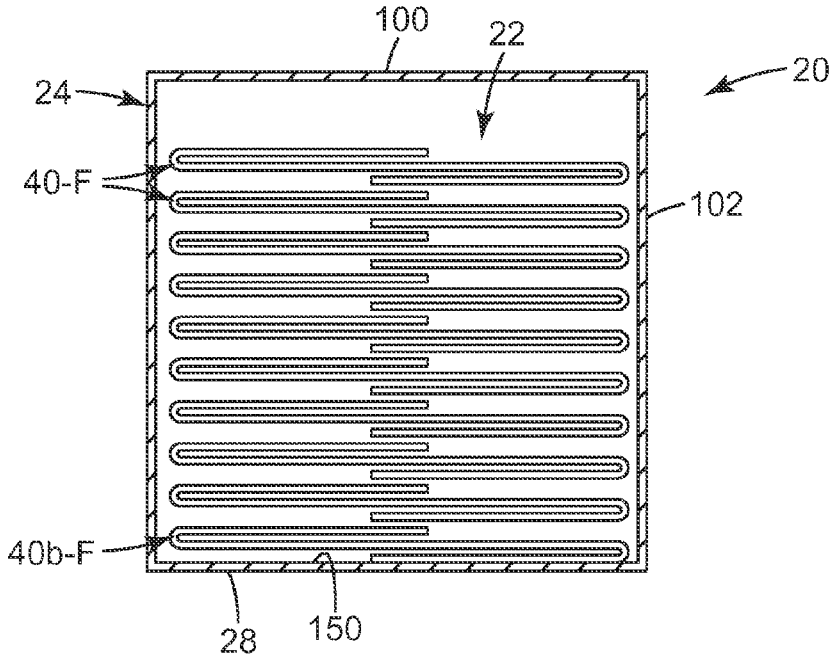
FIG. 8A is a simplified cross-sectional view of the system of FIG. 1 and illustrating the container in the closed state.
Figure 8B:
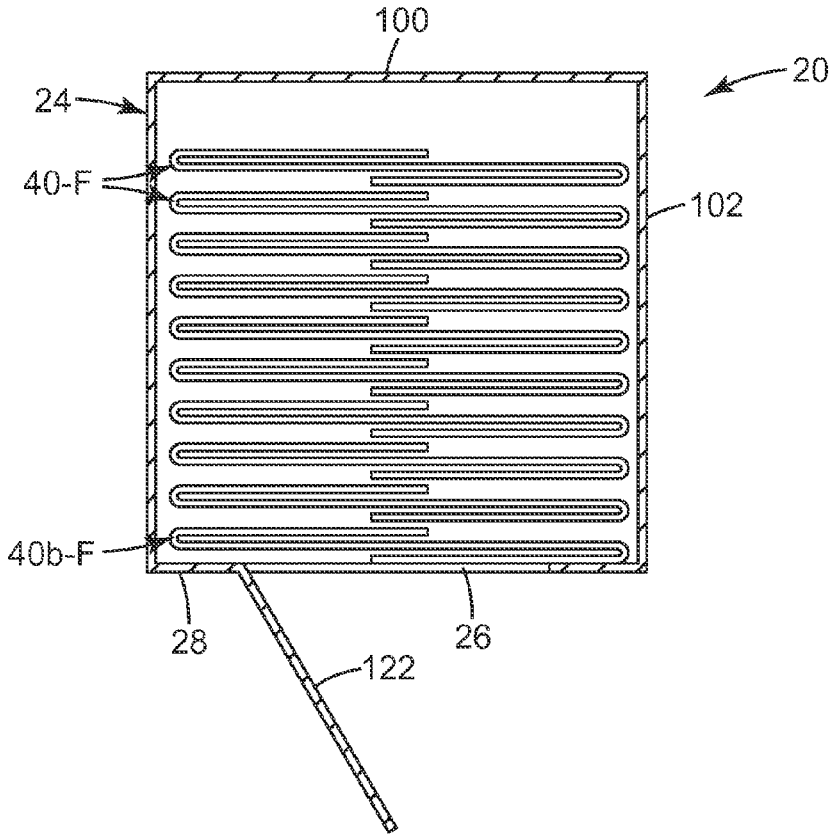
FIG. 8B is a simplified cross-sectional view of the system of FIG. 1 and illustrating the container in an open state.
Figure 8C:
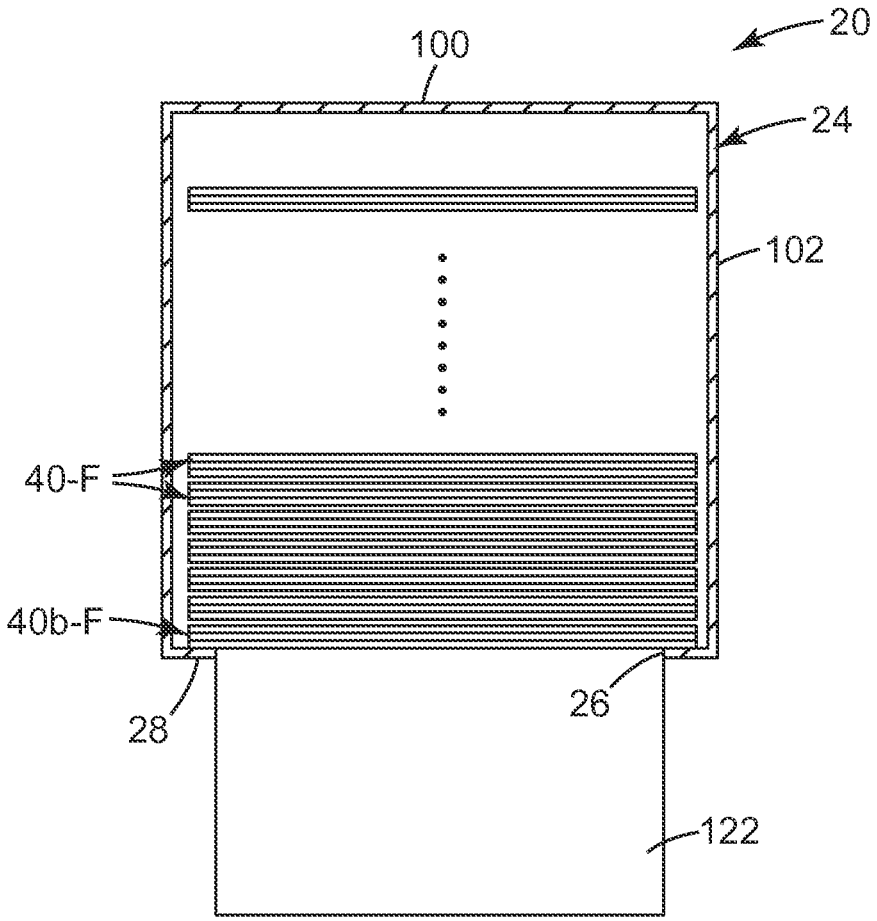
FIG. 8C is a simplified cross-sectional view of the system of FIG. 1, including the container in the open state and from a view 90 degrees orthogonal to the view of FIG. 8B.
Figure 9:
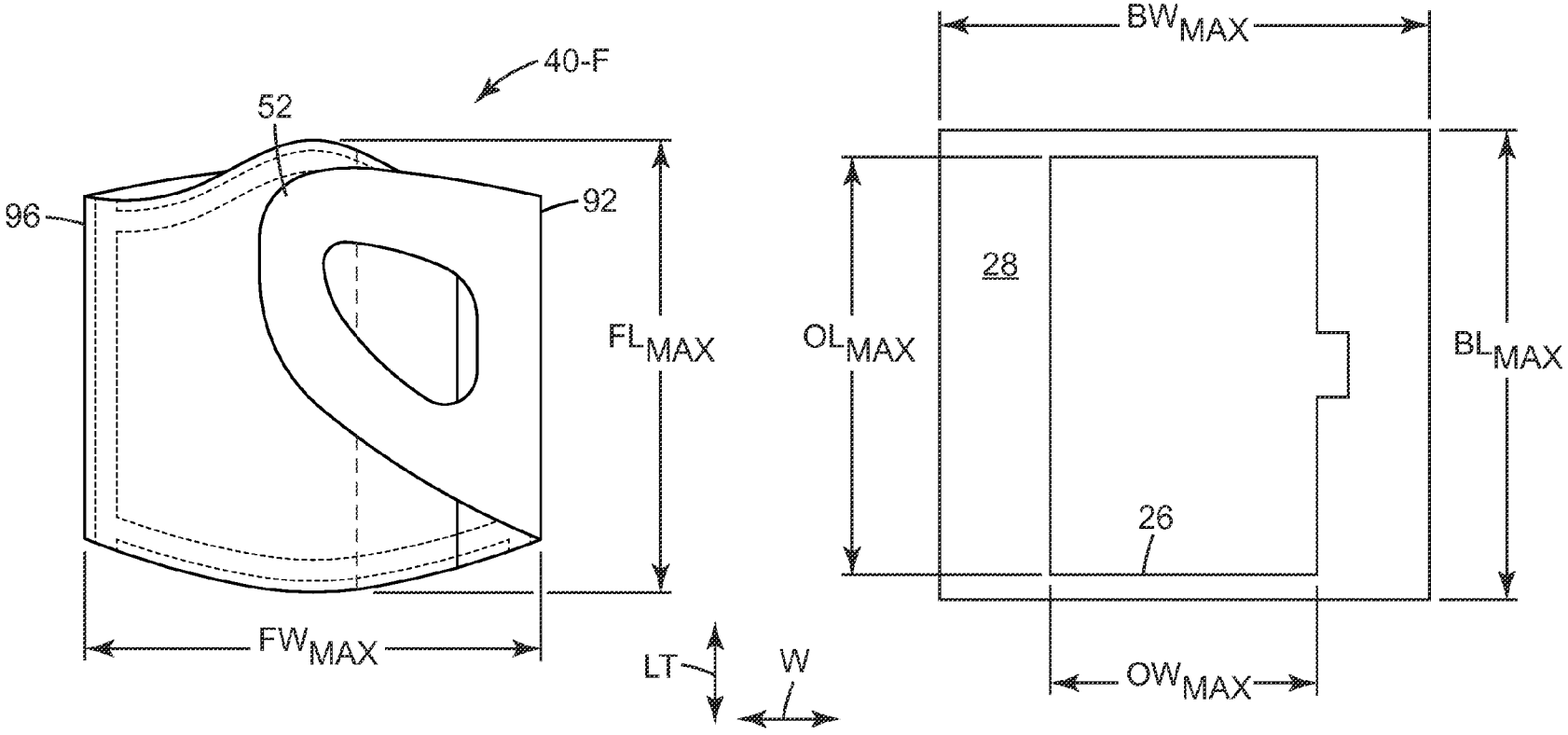
FIG. 9 is a plan view illustrating dimensional relationships between the folded face mask of FIG. 4C and the bottom panel of FIG. 7A.
Figure 10:
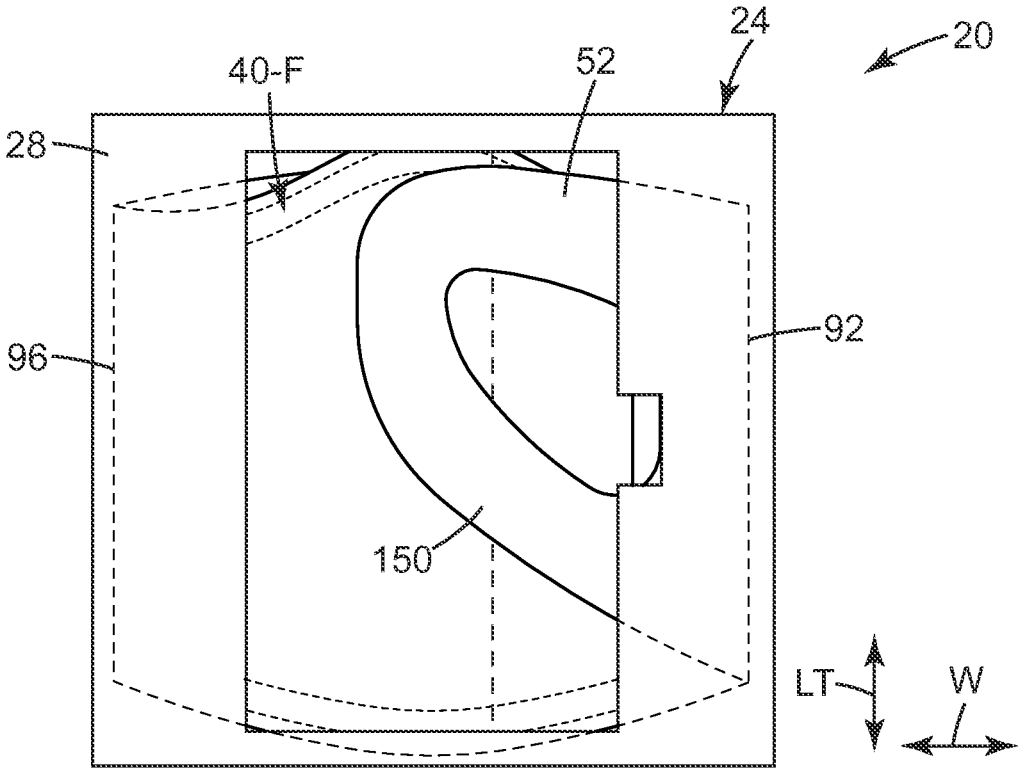
FIG. 10 is a simplified bottom view of the system of FIG. 1 and illustrating a relationship of a bottommost folded face mask relative to the opening in the bottom panel.
Figure 11B:
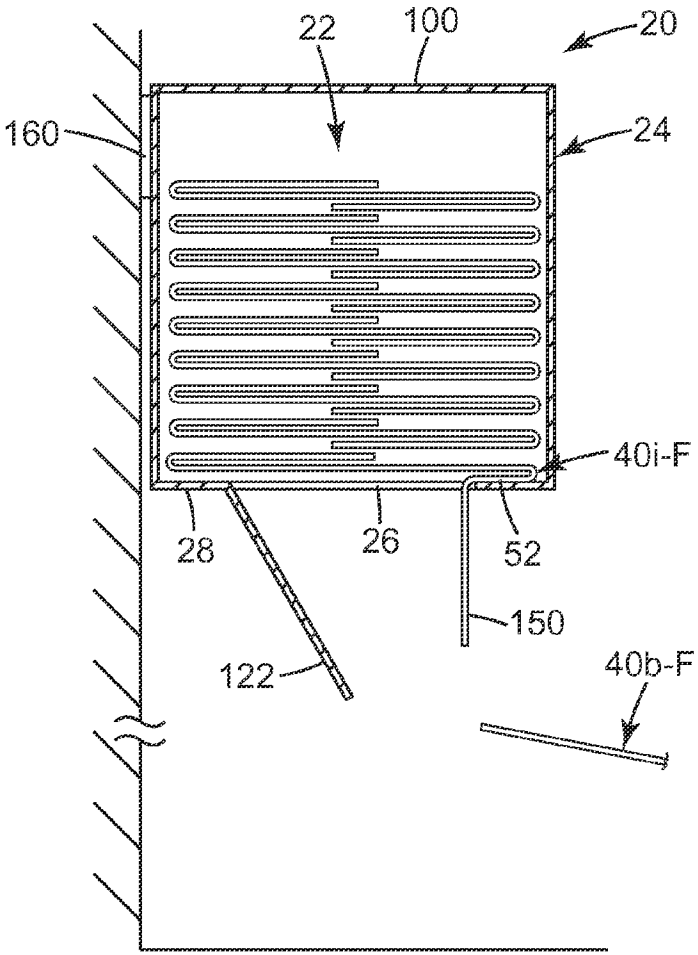
FIGS. 11A and 11B are simplified cross-sectional views illustrating use of the system of FIG. 1 in dispensing individual face masks.
Figure 11A:
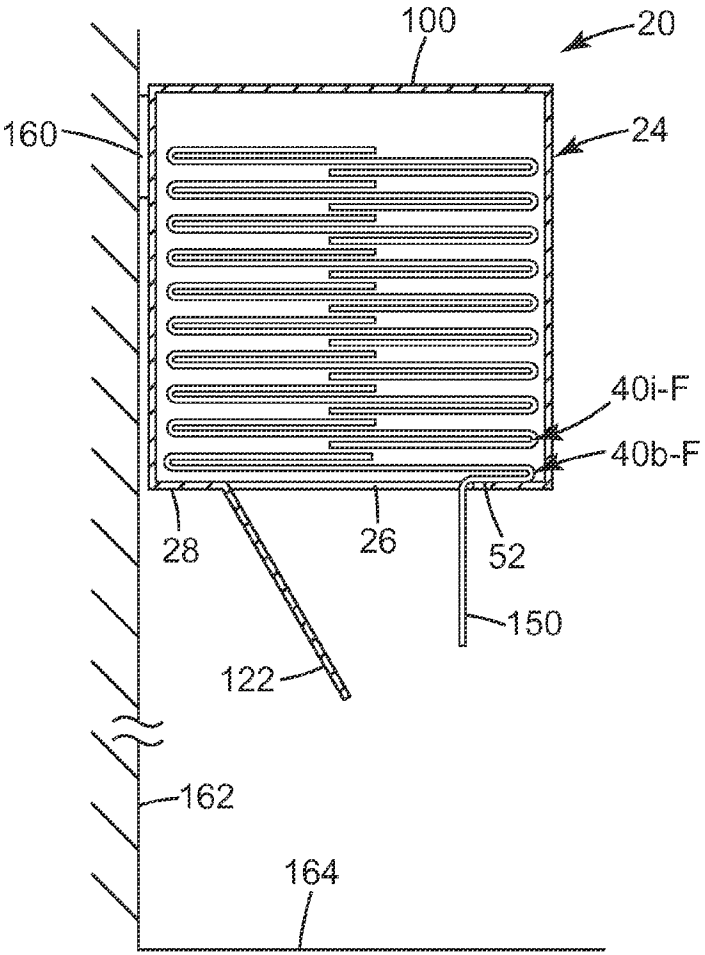

The size and shape of the opening 26, the bottom panel 28, and the folded face masks 40-F (FIG. 4C) are related to one another in a manner that facilitates dispensing of an individual face mask 40-F through the opening 26 while at all times supporting and retaining a remainder of the face mask stack 22. In this regard, FIG. 8A illustrates the face mask stack 22 disposed within the container 24, with the container 24 in an upright orientation (i.e., the bottom panel 28 is below the top panel 100). In any of the embodiments of the face mask stack 22 disclosed herein, the number of individual folded face masks 40-F in the stack 22 is unlimited and may be, for example, at least 10, 20, 30, 40 or 50 and up to, for example, 300, 250, 200 or 100. Regardless, the bottommost folded face mask 40*b*-F of the stack 22 is placed against, or abuts, an interior surface 150 of the bottom panel 28. Remaining ones of the folded face masks 40-F of the stack 22 are consecutively arranged on top of the bottommost folded face mask 40*b*-F, with the stack 22 thus being supported by the bottom panel 28. In the closed state of the container 24 in FIG. 8A, the flap 122 is contiguous with the remainder of the bottom panel 28 such that the bottommost folded face mask 40*b*-F cannot be accessed and is entirely supported. In the open state of FIGS. 8B and 8C, the opening 26 now exists (e.g., the flap 122 has been at least partially removed from a remainder of the bottom panel 28), permitting access to the bottommost folded face mask 40*b*-F. As a point of reference, in the view of FIG. 8C (otherwise illustrating a cross-section of the system 20 from an end perspective), a slight gap has been added between the folded face masks 40-F for ease of illustration). The area of the bottommost folded face mask 40*b*-F otherwise aligned with the opening 26 is no longer supported by the bottom panel 28, and promotes dispensing of the bottommost folded face mask 40*b*-F as described elsewhere. Due to the dimensional relationships below, however, the bottommost folded face mask 40*b*-F remains supported by the bottom panel 28, as is the remainder of the face mask stack 22. To better understand their relationships, FIG. 9 designates various dimensional attributes of the folded face mask 40-F, the bottom panel 28, and the opening 26. In the folded state, the folded face mask 40-F defines a width direction W, a length direction LT, a folded face mask maximum width $FW_{MAX}$, and a folded face mask maximum length $FL_{MAX}$. The bottom panel 28 can also be viewed as defining the width and length directions W, LT, as well as a bottom panel maximum width $BW_{MAX}$ and a bottom panel maximum length $BL_{MAX}$. The opening 26 corresponds with the bottom panel 28 in terms of the width and length directions W, LT and has an opening maximum width $OW_{MAX}$ and an opening maximum length $OL_{MAX}$. With these designations in mind, the various maximum width and length dimensions of the folded face mask 40-F, the bottom panel 28, and the opening 26 are selected to ensure that when the folded face mask 40-F is placed onto the bottom panel 28, the first lateral end portion 52 of the folded face mask 40-F can freely extend through the opening 26 while a remainder of the folded face mask 40-F remains supported by the bottom panel 28. For example, and as shown in FIG. 10, when the folded face mask 40-F is arranged relative to the bottom panel 28 such that the width and length directions W, LT coincide, the first and second fold lines 92, 96 abut the bottom panel 28 (it being understood that in the view of FIG. 10, the fold lines 92, 96 are "behind" the bottom panel 28 and thus would not be visible), whereas at least a region 150 of the first lateral end portion 52 is aligned with the opening 26. Thus, at least the region 150 of the first lateral end portion 52 can freely pass through the opening 26, whereas a remainder of the folded face mask 40-F remains supported by the bottom panel 28. With additional reference to FIG. 9, the maximum width $FW_{MAX}$ of the folded face mask 40-F is greater than the maximum width $OW_{MAX}$ of the opening 26, or the maximum length $FL_{MAX}$ of the folded face mask 40-F is greater than the maximum length $OL_{MAX}$ of the opening 26, or both. In other embodiments, the opening maximum width $OW_{MAX}$ is less than a dimension of the first lateral end portion 52 in the width direction W (such that while the folded face mask 40-F is accessible through the opening 26, the first lateral end portion 52 will not drop through the opening 26). To ensure that the folded face mask 40-F is consistently located along the bottom panel 28 such that the first lateral end portion 52 is aligned with the opening 26 as described above, the opening 26 is substantially centered relative to a surface area of the bottom panel 28, and the bottom panel 28 and the folded face mask 40-F have substantially similar maximum length and width dimensions to minimize "shifting" of the folded face mask 40-F relative to the opening 26. Thus, in some embodiments, the maximum width $BW_{MAX}$ of the bottom panel 28 is slightly greater than (e.g., not more than 10 percent greater than) the maximum width $FW_{MAX}$ of the folded face mask 40-F, and the maximum length $BL_{MAX}$ of the bottom panel 28 is slightly greater than (e.g., not more than 10 percent greater than) the maximum length $FL_{MAX}$ of the folded face mask 40-F. In a dispensing mode of the system 20 generally reflected in FIG. 11A, the container 24 is held in an upright position. For example, a support structure 160 (e.g., a frame, one or more stretch-release adhesive tape strips, etc.) connect the container 24 to a wall 162, and hold the container 24 above a floor 164. As shown, then, the bottom panel 28 is below the top panel 100 and faces the floor 164. The dispensing mode further entails at least partial removal of the flap 122 from a remainder of the bottom panel 28 (i.e., the container 24 is transitioned to the open state). With the flap 122 at least partially removed, the opening 26 in the bottom panel 28 is complete, thereby exposing the first lateral end portion 52 of the bottommost folded face mask 40*b*-F. Due to gravity, the exposed region 150 of the first lateral end portion 52 naturally drops through the opening 26, and is thus visible from an exterior of the container 24. However, a remainder of the bottommost folded face mask 40*b*-F is retained with the container 24. When dispensing of the bottommost folded face mask 40*b*-F is desired, a user readily visually perceives the outwardly hanging exposed region 150 of the first lateral end portion 52, and intuitively understands that the bottommost folded face mask 40*b*-F can be removed from the container 24 by simply grasping and pulling on the exposed region 150. With alternative embodiments in which a size of the opening 26 does not permit the first lateral end portion 52 drop through due to gravity, the end user will reach through the opening 26 to and grasp the bottommost folded face mask 40*b*-F to effectuate dispensement. In this regard, the end user's fingers will not touch any other face mask in the stack 22. Once the bottommost face mask 40*b*-F is removed from the container 24, the immediately next folded face mask 40*i*-F "moves" into abutment with the bottom panel 28 as shown in FIG. 11B. The first lateral end portion 52 (or the second lateral end portion 54) of the immediately next folded face mask 40*i*-F is now directly aligned with the opening 26, and at least the region 150 naturally drops through the opening 40 due to gravity and is thus available to facilitate dispensing of the immediately next folded face mask 40*i*-F as described above. Notably, even with the region 150 of the first lateral end portion 52 of the immediately next folded face mask 40*i*-F exposed through the opening 26, a remainder of the immediately next folded face mask 40*i*-F is in contact with the bottom panel 28. Thus, the immediately next folded face mask 40*i*-F continues to be retained by the container 24, as does a remainder of the folded face masks 40-F of the stack 22 that are otherwise "above" the immediately next folded face mask 40*i*-F.

The above-described system 20 advantageously allows for face masks to be removed one-at-a-time from the container 24. A variety of shapes may be useful for the container 24 in dispensing the face masks disclosed herein. For example, the container 24 may be in the shape of a cube; a triangle, square, or rectangular pyramid; a triangular, trapezoidal, or rectangular prism; cylinder; or other useful shape. With configurations in which the flap 122 remains connected to the bottom panel 28 in the open state, the container 24 can be arranged relative to the wall 162 such that the pivoted flap 122 is proximate the wall 162 as shown. The bottommost folded face mask 40*b*-F can be arranged within the container 24 such that the exposed region 150 of the corresponding first lateral end portion 52 drops from the opening 26 opposite the extended flap 122. Alternatively, the bottommost folded face mask 40*b*-F can be arranged to locate the exposed region 150 immediately adjacent the extended flap 122. Regardless, the flap 122/bottom panel 28 is optionally configured such that the flap 122 self-retains the open position (due at least in part to gravity) until returned to the closed position by a user.

Figure 12:
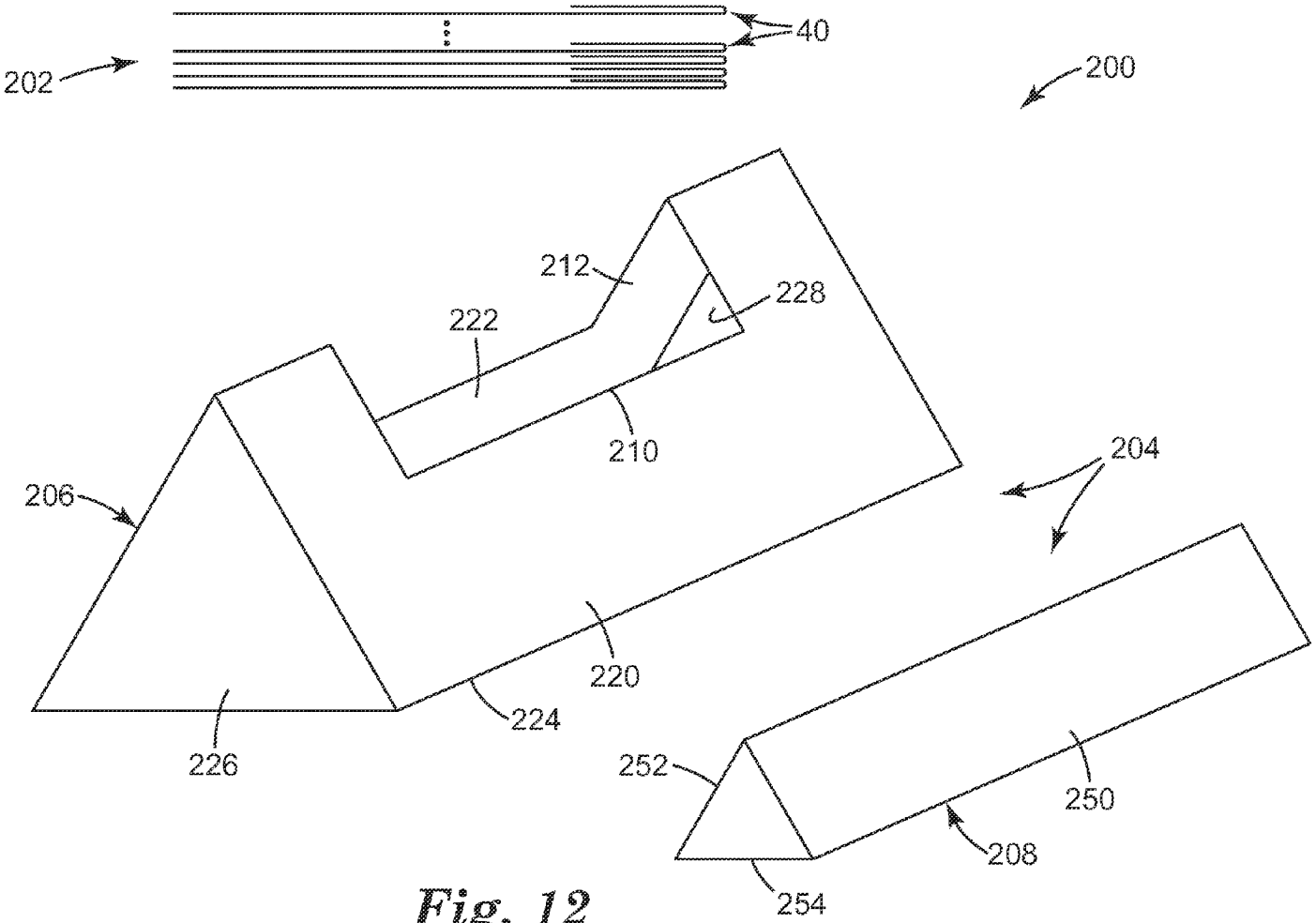
FIG. 12 is a simplified exploded view, with portions in perspective, of another system for packaging and dispensing face masks in accordance with the principles of the present disclosure.

Another embodiment face mask packaging and dispensing system 200 in accordance with principles of the present disclosure is shown in FIG. 12. The system 200 includes a face mask stack 202 and a dispenser assembly 204. Details on the various components are provided below. In general terms, however, the dispenser assembly 204 includes a container 206 and a core 208. The face mask stack 202 and the core 208 are disposed within the container 206, with the face mask stack 202 located or wrapped about the core 208. Individual face masks 40 from the stack 202 can be dispensed or removed from the container 206 via an opening 210 selectively formed in the container 206, with the core 208 maintaining a desired relationship of each of the face masks 40 relative to the opening 210 in a manner that facilitates easy grasping of a next-available one of the face masks 40.

Figure 13:
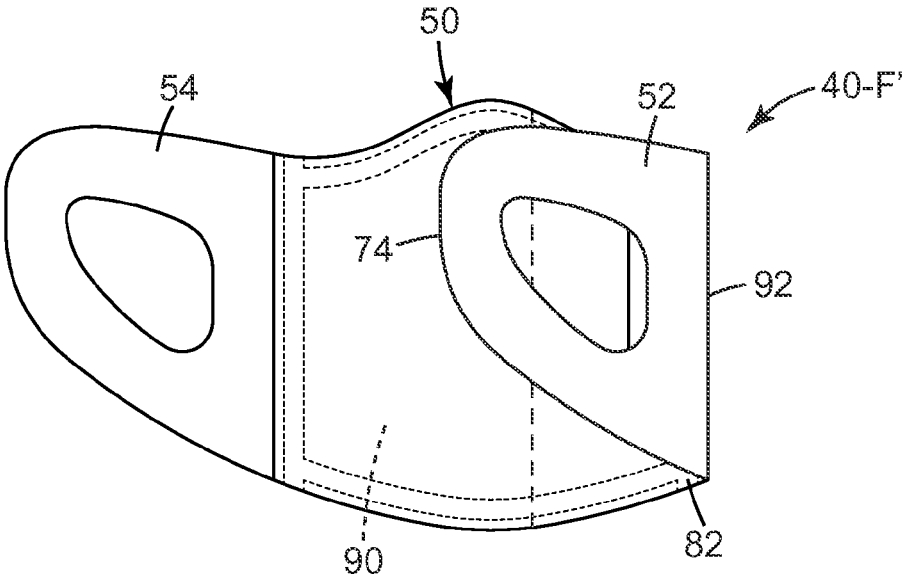
FIG. 13 is a plan view of a folded face mask useful with the system of FIG. 12.

As implied by the above, the individual face masks 40 comprising the face mask stack 202 can be identical to the descriptions above. While each of the face masks 40 within the stack 202 is folded, with embodiment of FIG. 12, a differing fold arrangement can be employed. More particularly, and as shown in FIG. 13, each of the face masks 40 associated with the face mask stack 202 (FIG. 12) has a single fold in which the first lateral end portion 52 is folded over the first face 90 of the central portion 50 at the first fold line 92. The second lateral end portion 54 remains unfolded relative to the central portion 50 as shown. Consistent with previous descriptions, the first bondline segment 82 (that otherwise demarcates the central portion 50 from the first lateral end portion 52) serves as a convenient location for the fold to be made, with the first lateral end portion 52 extending from the first fold line 92 to the first side edge 74 that is otherwise located within an area of the central portion 50. For ease of explanation, the folded arrangement of FIG. 13 is referenced below as a folded face mask 40-F'.

Figure 14:
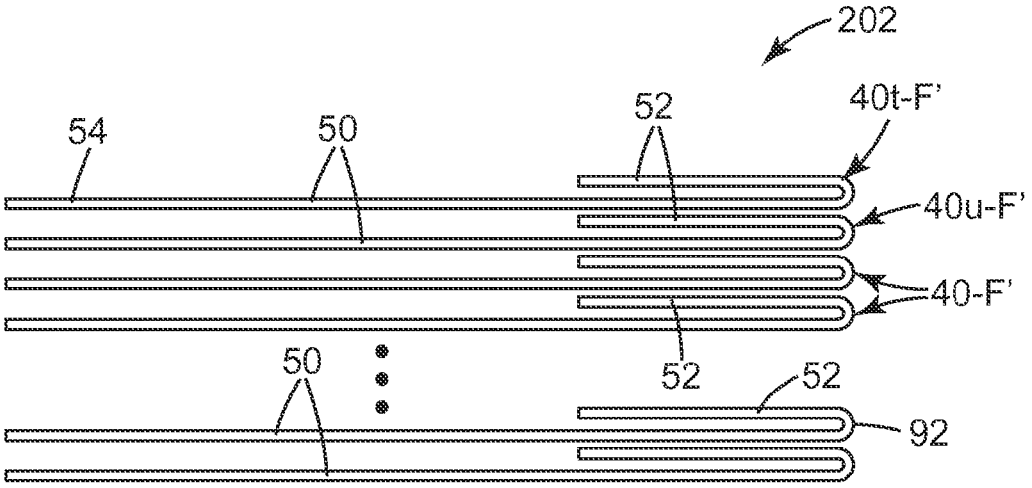
FIG. 14 is a side view of a stack of folded face masks useful with the system of FIG. 12.

With reference to FIG. 14, the folded face masks 40-F' can be identically arranged within the face mask stack 202. For example, the first lateral end portion 52 of each of the folded face masks 40-F' are all aligned (e.g., relative to the orientation of FIG. 14, the folded first lateral end portions 52 are all on the right hand side). Thus, the first lateral end portion 52 of a topmost folded face mask 40*t*-F' is aligned with the first lateral end portion 52 of an immediately underlying folded face mask 40*u*-F'. Remaining ones of the folded face masks 40-F' can be similarly arranged as shown. Alternatively, one or more of the folded face masks 40-F' within the face mask stack 202 can be arranged in an opposite orientation (e.g., the second lateral end portion 54 of the immediately underlying folded face mask 40*u*-F' can be aligned with the first lateral end portion 52 of the topmost folded face mask 40*t*-F'). Regardless of the orientation of the individual folded face masks 40-F', the folded face masks 40-F' are arranged such that the corresponding first lateral end portion 52 faces upwardly (e.g., the first lateral end portion 52 of the immediately underlying folded face mask 40*u*-F' faces or abuts the topmost folded face mask 40*t*-F'). As with previous embodiments, consecutive ones of the folded face masks 40-F' need not be interfolded to one another.

Returning to FIG. 12, the container 206 defines an interior volume 212 sized to maintain the face mask stack 202 and the core 208. In some embodiments, the container 206 is a triangular prism in shape (e.g., a right triangular prism), defined by first-third side panels 220-224 (the third side panel 224 is hidden in the view of FIG. 12 and is referenced generally), and first and second end panels 226, 228 (the second end panel 228 is primarily hidden in the view of FIG. 12 and is referenced generally). The panels 220-228 can be formed from a variety of materials (e.g., paperboard, plastic, etc.), and adjacent ones of the panels 220-228 can be homogenously formed. For example, in some embodiments, the container 206 is formed from a cut paperboard blank that is folded to form the completed container 206. Alternatively, one or more of the panels 220-228 can be separately formed and subsequently assembled to one another. In other embodiments, one or more of the panels 220-228 are defined by two (or more) panel sections that are separately formed and subsequently assembled. Regardless, a size of the interior volume 212 is sufficient to receive the core 208 as well as the face mask stack 202 otherwise consisting of at least 10 of the folded face masks 40-F' or as many as 500 (or more) of the folded face masks 40-F'.

Figure 15A:
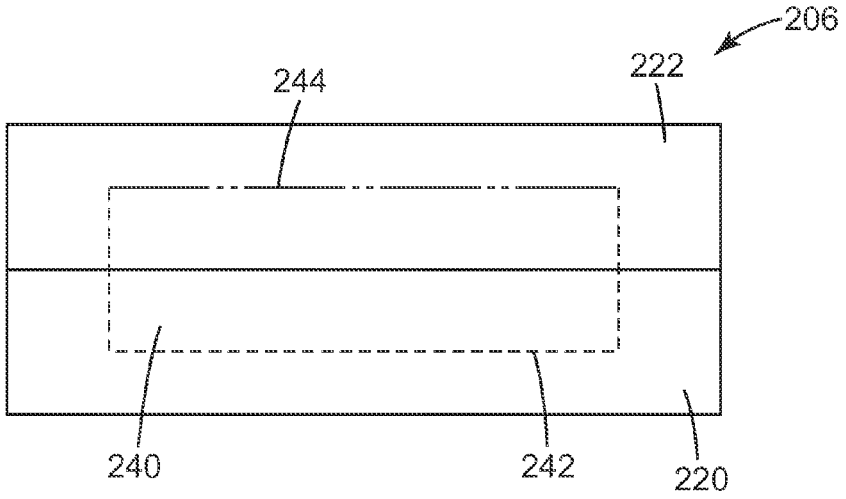
FIG. 15A is a simplified top view of a container portion of the system of FIG. 12 in a closed state.
Figure 15B:
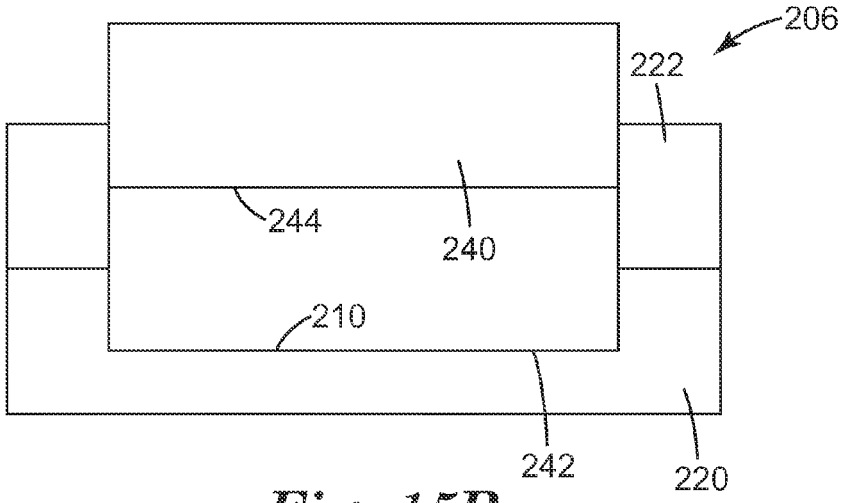
FIG. 15B is a simplified top view of the container of FIG. 15A and in an open state.

In some embodiments, the opening 210 is generated by removal (partial or complete removal) of a flap 240 defined by a cut-line 242 extending along a portion of the first and second side panels 220, 222 as shown in FIG. 15A. The cut-line 242 can assume various forms, and in some embodiments is a line of perforations. With the configuration of FIG. 15A, the cut-line 240 is discontinuous such that the flap 240 is permanently connected to a remainder of the container 206 (e.g., the second side panel 222) at a hypothetical connection line 244 (referenced generally). With this construction, the flap 240 can transition from the closed state of FIG. 15A in which the flap 240 is contiguous with the remainder of the container 206 at the cut-line 242 (e.g., where the cut-line 242 is a line of perforations, the flap 240 is intermittently connected to the reminder of the container 206 at the perforations in the closed state) to an open state illustrated in FIG. 15B in which a portion of the flap 240 is removed or withdrawn from the remainder of the container 206 (with the flap 240 effectively pivoting at the connection line 244 in transitioning from the closed state to the open state). In the open state, then, the opening 210 is formed through the first and second side panels 220, 222, with the flap 240 pivoted away from the opening 210.

Figure 16:
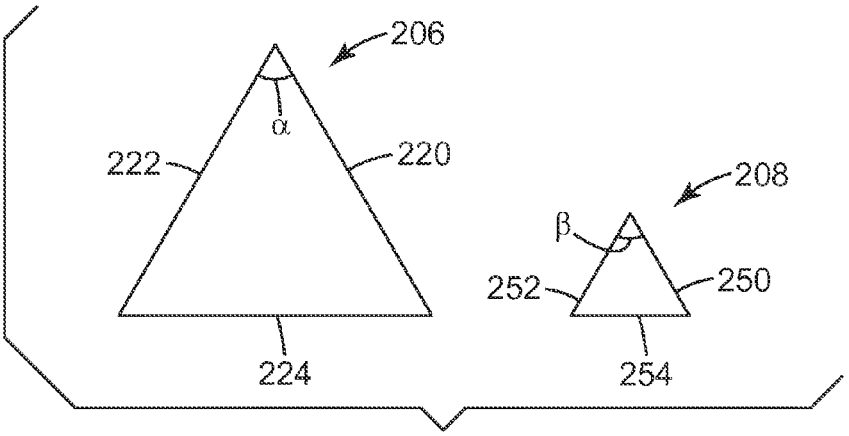
FIG. 16 is a simplified side view of the container and a core portion of the system of FIG. 12.

Returning to FIG. 12, the core 208 has a shape substantially commensurate with that of the container 206, with the core 208 being smaller in size. Thus, the core 208 can have the triangular prism shape as shown, defined by first-third walls 250-254 (in the view of FIG. 12, the second and third walls 252, 254 are hidden and are referenced generally). With reference to FIG. 16, an angular relationship between first-third walls 250-254 is substantially similar to the angular relationship established by the first-third side panels 220-224 of the container 206. Thus, for example, an angle β between the first and second walls 250, 252 is substantially similar (e.g., within 10 degrees) to an angle α between the first and the second side panels 220-222. In some embodiments, the side panels 220-224 and the walls 250-254 each define an equilateral triangle, although other shapes are also acceptable.

The core 208 can be formed from a variety of materials, such as paperboard, plastic, etc. The core 208 can be hollow and need not include end walls. In other embodiments, the core 208 is a solid body.

Figure 17:
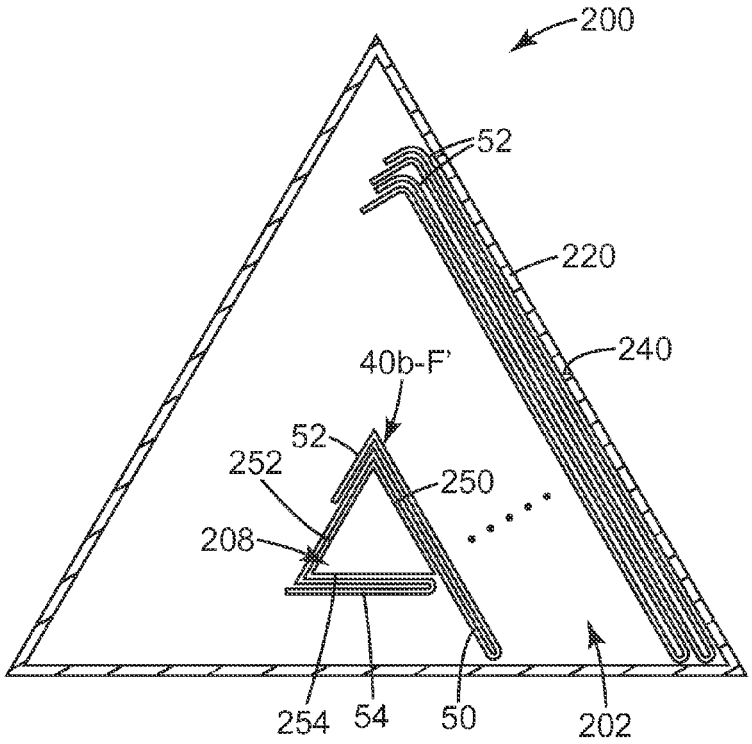
FIG. 17 is a simplified cross-sectional view of the system of FIG. 12, including the container in the closed state.

FIG. 17 depicts the container 206 loaded with the face mask stack 202 and the core 208. As shown, the face mask stack 202 is loosely wrapped about the core 208. In some constructions, the folded first lateral end portion 52 of the each of the folded face masks 40-F' are aligned with one another, and are located adjacent, but facing away from, the first wall 250 of the core 208 (e.g., relative the bottommost folded face mask 40*b*-F', the folded first lateral end portion 52 is aligned with the first wall 250, and the corresponding central portion 50 that is otherwise "beneath" the first lateral end portion 52 contacts the first wall 250). The central portion 50 of each of the folded face masks 40-F' wraps about the second wall 252, with the second lateral end portion 54 being loosely tucked "under" (relative the orientation of FIG. 17) the third wall 254. With this construction, then, the folded first lateral end portion 52 of each of the folded face masks 40-F' "faces" the first side panel 220 of the container 206.

Figure 18:
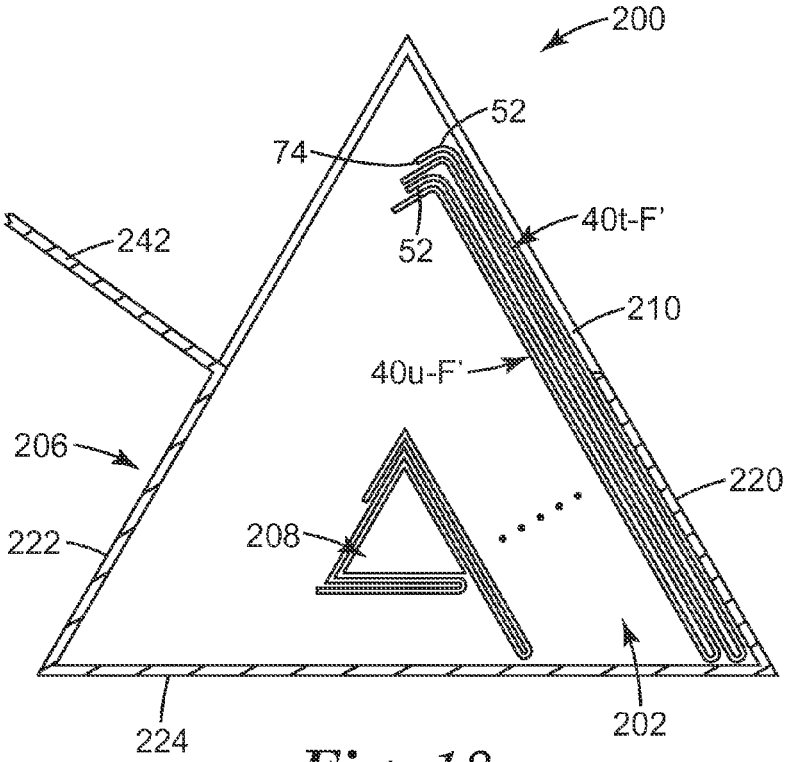
FIG. 18 is a simplified cross-sectional view of the system of FIG. 12, including the container in the open state for dispensing of individual face masks.

In the closed state of the container 206 (i.e., the flap 242 (FIGS. 15A and 15B) is contiguous with a remainder of the container 206 along the cut-line 240 (FIG. 15A)), the opening 210 (FIG. 15B) does not exist and the face mask stack 202 is fully contained within the container 206. In a dispensing mode of the system 200 shown in FIG. 18 the flap 242 is at least partially removed from the first and second panels 220, 222, thereby creating the opening 210. Due to the orientation of the face mask stack 202, as dictated by the core 208, the first lateral end portion 52 of the topmost face mask 40*t*-F' is aligned with or exposed at the opening 210. A user simply grasps the exposed first lateral end portion 52 (e.g., at the first side edge 74), and pulls the topmost face mask 40*t*-F' from the container 206. Once the topmost folded face mask 40*t*-F' is removed, the first lateral end portion 52 of the immediately underlying folded face mask 40*u*-F' is now exposed and available for grasping at the opening 210. The core 208 serves to maintain the desired orientation of the individual folded face masks 40-F relative to the opening 210 throughout the dispensing operation.

Face mask packaging and dispensing systems of the present disclosure provide a marked improvement over previous designs. Conformable, single-piece type face masks are easily packaged within a container by simply folding the face masks individually and then stacking the folded face masks. The system is easily transitioned to a dispensing mode in which a to-be-dispensed face mask is readily identified and grasped by a user.

Although the present invention has been described with reference to preferred embodiments, workers skilled in the art will recognize that changes can be made in form and detail without departing from the spirit and scope of the present invention.

What is claimed is:

1. A system for containing a stack of a plurality of face masks and dispensing individual face masks from the stack, the system comprising:

a container defining an interior volume and including a top panel and a bottom panel;

wherein the bottom panel forms a cut-line defining a perimeter of a flap that is transitionable from an initial, closed state in which the flap is contiguous with a remainder of the bottom panel to an open state in which the flap is at least partially removed from the remainder of the bottom panel to generate an opening in the bottom panel to the interior volume; and a stack of a plurality of folded face masks disposed in the interior volume, each of the folded face masks including an elastic sheet forming a central portion and opposing first and second lateral end portions extending from opposite sides, respectively, of the central portion, and folded such that at least a section of the corresponding first lateral end portion extends from a first fold line along a first face of the corresponding central portion;

wherein the stack includes a bottommost folded face mask located proximate the bottom panel, the first lateral end portion of the bottommost folded face mask facing the bottom panel;

and further wherein the system provides a dispensing mode in which:

the top panel is above the bottom panel, the flap is in the open state, at least a region of the first lateral end portion of the bottommost folded face mask drops through the opening due to gravity, the central portion of the bottommost folded face mask is retained within the interior volume.

2. The system of claim 1, wherein the dispensing mode includes the bottommost folded face mask abutting the bottom wall.

3. The system of claim 1, wherein the dispensing mode includes at least a portion of the first lateral end portion of the bottommost folded face mask being retained within the interior volume.

4. The system of claim 1, wherein the dispensing mode includes the first fold line of the bottommost folded face mask abutting the bottom panel.

5. The system of claim 4, wherein each of the folded face masks includes at least a section of the corresponding second lateral end portion extending from a second fold line along a second face of the corresponding central portion opposite the first face, and further wherein the dispensing mode further includes the second fold line of the bottommost folded face mask abutting the bottom panel.

6. The system of claim 1, wherein the dispensing mode includes the bottommost folded face mask extending across an entirety of at least one of a width and a length of the opening.

7. The system of claim 1, wherein the dispensing mode includes the region of the first lateral end portion of the bottommost folded face mask being available for grasping by a user from a location exterior the interior volume for removing the bottommost folded face mask from the container.

8. The system of claim 1, wherein the cut-line is a line of perforations.

9. The system of claim 1, where the cut-line is discontinuous such that in the open state, the flap remains connected to the remainder of the bottom panel.

10. The system of claim 9, wherein the flap is completely connected to the remainder of the bottom panel in the open state along a connection line, the flap being pivotable relative to the remainder of the bottom panel at the connection line.

11. The system of claim 10, wherein the flap defines a leading end opposite the connection line, and further wherein the open state includes the leading end pivoted away from the remainder of the bottom panel, and even further wherein the flap self-retains the open state in the dispensing mode due, at least in part, to gravity.

12. The system of claim 1, wherein the opening has a shape defining a maximum width and a maximum length, and each of the folded face masks has a shape defining a maximum width and a maximum length, the folded face masks being arranged within the interior volume such that a width direction of the folded face masks is aligned with a width direction of the opening, and even further wherein a dimensional relationship between the opening and each of the folded face masks provides at least one of:

the maximum width of the opening is less than the maximum width of each of the folded face mask, and the maximum length of the opening is less than the maximum length of the folded face mask.

13. The system of claim 12, wherein each of the folded face masks includes at least a section of the corresponding second lateral end portion extending from a second fold line along a second face of the corresponding central portion opposite the first face, and even further wherein the maximum width of the folded face masks is defined by a distance between the corresponding first and second fold lines.

14. The system of claim 13, wherein a side edge of the first lateral end portion of each of the folded face masks terminates along the corresponding central portion between the corresponding first and second fold lines.

15. The system of claim 12, wherein the bottom panel defines a maximum width and a maximum length of the container, the maximum width of the container arranged in a direction of the maximum width of the opening, and further wherein the maximum width of the container is not greater than 150 percent of the maximum width of the folded face masks.

16. The system of claim 12, wherein the flap is connected to the remainder of the bottom panel along a connection line in the open state, and further wherein the opening has a perimeter defined by the connection line, a leading edge opposite the connection line, and opposing side edges, even further wherein the maximum width of the opening is defined by a distance between the leading edge and the connection line.

17. The system of claim 16, where in the opposing side edges are curved in extension between the connection line and the leading edge.

18. The system of claim 1, further comprising:

a retainer device for hanging the container from a wall.

19. A method of packaging a plurality of face masks within a container, each of the face masks including an elastic sheet forming a central portion and opposing first and second lateral end portions extending from opposite sides, respectively of the central portion, the method comprising:

folding each of the face masks such that at least a section of the corresponding first lateral end portion extends from a first fold line along a first face of the corresponding central opening, and at least a section of the corresponding second lateral end portion extends from a second fold line along a second face of the corresponding central portion opposite the first face;

disposing a plurality of the folded face masks within interior volume of a container, including consecutive face masks being stacked one above the other such that a bottommost folded face mask of the stack abuts a bottom panel of the container;

wherein the bottom panel forms a cut-line defining a perimeter of a flap that is at least partially removable from a remainder of the bottom panel;

and even further wherein upon arranging the container such that the bottom panel is below a top panel thereof and transitioning the flap to an open state such that an opening is formed in the bottom panel to the interior volume, a region of the first lateral end portion of the bottommost folded face mask drops through the opening due to gravity, whereas a remainder of the bottommost folded face mask is retained within the interior volume.

20. The method of claim 19, wherein the bottommost folded face mask is arranged within the container such that the corresponding first and second fold lines abut the bottom panel.

21. A system for containing a stack of a plurality of face masks and dispensing individual face masks from the stack, the system comprising:

a dispenser assembly including:

a container defining an interior volume and including first and second panels connected at a fold line, wherein a cut-line extends across the first and second panels and defines a perimeter of a flap that is transitionable from a closed state to an open state in which the flap is at least partially removed from a remainder of the first and second panels to generate an opening in the container to the interior volume, a core sized and shaped to be entirely disposed within the interior volume; and a stack of a plurality of folded face masks, each of the folded face masks including an elastic sheet forming a central portion and opposing first and second lateral end portions extending from opposing sides, respectively, of the central portion, and folded such that at least a section of the corresponding first lateral end portion extends from a first fold line along a first face of the corresponding central portion;

wherein the stack is wrapped about the core and is disposed within the interior volume, including the first lateral end portion of a topmost folded face mask facing the flap for dispensement through the opening when the container is transitioned to the open state.

* * * * *